US006796281B2

(12) United States Patent
Shimoyama et al.

(10) Patent No.: US 6,796,281 B2
(45) Date of Patent: Sep. 28, 2004

(54) INTERNAL COMBUSTION ENGINE WITH VALVE TRAIN

(75) Inventors: Kazuaki Shimoyama, Saitama (JP); Hiroyuki Mamiya, Saitama (JP); Ikuro Hara, Saitama (JP); Hidemi Arai, Saitama (JP); Masaru Asari, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/298,526

(22) Filed: Nov. 19, 2002

(65) Prior Publication Data

US 2003/0094155 A1 May 22, 2003

(30) Foreign Application Priority Data

Nov. 19, 2001 (JP) ..... P. 2001-353131
Dec. 26, 2001 (JP) ..... P. 2001-394062

(51) Int. Cl.[7] ..... F02N 3/00
(52) U.S. Cl. ..... 123/188.2; 123/90.41
(58) Field of Search ..... 123/188.2, 90.4, 123/90.41, 90.23, 90.39, 90.16, 90.18, 90.22, 90.34, 90.27, 90.33, 193.5

(56) References Cited

U.S. PATENT DOCUMENTS

| | | | | |
|---|---|---|---|---|
| 3,563,215 A | | 2/1971 | Ross | |
| 4,823,747 A | | 4/1989 | Wagner et al. | |
| 5,125,374 A | * | 6/1992 | Saito | 123/90.43 |
| 5,150,675 A | * | 9/1992 | Murata | 123/193.5 |

FOREIGN PATENT DOCUMENTS

| | | |
|---|---|---|
| DE | 198 45 942 A1 | 4/2000 |
| EP | 0 907 008 A1 | 8/1998 |
| JP | 6-299807 | 10/1994 |
| JP | 2000-161025 | 6/2000 |

* cited by examiner

*Primary Examiner*—Tony M. Argenbright
*Assistant Examiner*—Hyder Ali
(74) *Attorney, Agent, or Firm*—Arent Fox PLLC

(57) ABSTRACT

A valve train of an internal combustion engine has rocker arms which are spherically supported on lash adjusters and camshafts disposed above the rocker arms. The camshafts are rotatably supported on a cam holder including a lower cam holder which is fastened to a cylinder head and an upper cam holder. Projections for preventing the fall of the rocker arms in axial directions of the camshafts through the contact with the rocker arms are provided on bearing portions and partitioning portions which are integrally formed on the lower cam holder in such a manner as to face both sides in the axial direction of the rocker arms.

18 Claims, 10 Drawing Sheets

INTERNAL COMBUSTION ENGINE WITH VALVE TRAIN

BACKGROUND OF THE INVENTION

1. Field of the Invention

The present invention relates to an internal combustion engine with a valve train having rocker arms which are spherically supported at proximal end portions thereof and abut with engine valves at operating portions thereof and camshafts disposed above the rocker arms.

2. Description of the Related Art

Conventionally, JP-A-2000-161025 discloses an internal combustion engine with a valve train of this kind. In this internal combustion engine, the valve train comprises rocker arms which abut with valve stems at one end and which are spherically supported at the other end thereof by pivot ends fitted in mount holes in a cylinder head and camshafts disposed above the rocker arms. Cams rotating together with the camshaft are brought into sliding contact with rollers which are rotatably supported at central portions of the rocker arms and oscillate the rocker arms about the other end thereof which acts as an oscillating fulcrum, so as to operate valves to open and close.

Incidentally, in the related art, in assembling the rocker arms and the camshaft to the cylinder head, firstly, the rocker arms are assembled to the cylinder head such that one ends thereof are abutted with the valves slidably held in the cylinder head and the other ends thereof are supported on the pivot ends fitted in the mount holes in the cylinder head. Then the camshaft is lowered toward the rocker arms which are already assembled to the cylinder head, from above the rocker arms so assembled and is then assembled to the cylinder head in such a manner that the cams come into contact with the rollers of the rocker arms. However, since they are spherically supported at the other end thereof, the rocker arms tend to tilt in the axial direction of the camshaft. Then, when attempting to assemble the camshaft to the cylinder head in a state where the rocker arms tilt at an angle larger than an angle through which the rocker arms so tilting can be corrected through the contact with the cams assembled to the cylinder head or in a state where the rocker arms are fallen, there may occur a risk that the rocker arms come off or the surfaces of the cams which are formed of a material having a lower hardness than that of the abutment portions of the rocker arms with the cams are damaged through the contact with the abutment portions.

Due to this, when assembling camshafts, it is necessary to secure a state where the rocker arms occupy preset positions or positions at which the rocker arms do not tilt as resulting when the cams are in abutment with the rocker arms or a state where while the rocker arms slightly tilt, the tilt can be corrected through the abutment with the cams so that the rocker arms can occupy the preset positions. Therefore, a tremendously long time has been needed for assembling the camshafts.

To cope with this problem, it has been desired to provide in an internal combustion engine with a valve train having such rocker arms fall-preventive unit for preventing the fall of the rocker arms when the camshafts are assembled to thereby improve the assembling properties of the camshafts and to make the fall-preventive unit flexible in application depending upon layouts of the rocker arms relative to peripheral components.

In addition, conventionally, a camshaft holder is disclosed in JP-A-6-299807 as this type of integral cam holder for an internal combustion engine. In this camshaft holder (corresponding to the cam holder), crossbars for connecting both longitudinal side walls of the camshaft holder are integrally formed at positions corresponding to journal portions of an intake camshaft and an exhaust camshaft, respectively. An intake-side cam journal portion and an exhaust-side cam journal portion are formed on an upper surface of each of the crossbars. Thus, the camshaft holder is given a ladder frame construction, thereby increasing the rigidity thereof. Then, cam journal portions are formed on a lower surface of a cam cap which rides on an upper surface of the camshaft holder at positions corresponding, respectively, to the intake-side and exhaust-side cam journal portions of the crossbar. The cam caps are then bolted to a cylinder head together with the camshaft holder, whereby the camshafts are pivotally supported therebetween.

In general, it is preferable to increase the rigidity of the cam holder in order to secure stable valve train operations over the full operating range of the internal combustion engine. In this respect, according to the related art, since the cam cap to which the intake-side cam journal portion and the exhaust-side cam journal portion are connected is fastened to the crossbar, it is considered that the rigidity of the camshaft holder is increased further by the cam caps so constructed. However, in a case where a cam cap on which only an intake-side cam journal portion is formed and a cam cap on which only an exhaust-side cam journal portion is formed are used as a cam cap such that the separate cam caps are fastened to the crossbar, it is difficult to increase further the rigidity of the camshaft holder by the cam caps so constructed.

SUMMARY OF THE INVENTION

The invention was made in view of these situations, and a first object of the invention is to prevent the fall of rocker arms which are supported on spherical surfaces in an axial direction of camshafts so as to facilitate the assembly of the camshafts from above the rocker arms to thereby improve the assembling properties of an internal combustion engine with a valve train. Further, a second object of the invention is to provide an integral cam holder in which bearing portions provided adjacent to each other in an axial direction of a camshaft and primary and secondary longitudinal frames for connecting the bearing portions to each other are formed integrally, the rigidity of the integral cam holder being increased without depending upon the form of camshaft supporting members which are connected to the cam holder for rotatably supporting the camshaft.

According to a first aspect of the invention, there is provided an internal combustion engine with a valve train, comprising:

- a rocker arm having a proximal portion which is spherically supported by an oscillating support member and an operating portion abutting with an engine valve;
- a camshaft having a cam adapted to be brought into sliding contact with the rocker arm and disposed above the rocker arm, wherein the engine valve is operated to open and close by the rocker arm which is oscillated by the cam which rotates together with the camshaft; and
- fall-preventive units provided in such a manner as to face both sides of the rocker arm in an axial direction of the camshaft, for preventing the fall of the rocker arm in the axial direction through the contact with the rocker arm.

According to the construction, even in case the rocker arm which is supported on the spherical surface tries to fall in either of the axial directions, the rocker arm comes into contact with either of the fall-preventive units which are provided to face the sides of the rocker arm, whereby the fall of the rocker arm can be prevented. Consequently, according to the first aspect of the invention, the following advantage can be provided. Namely, even if the rocker arm which is supported on the spherical surface tries to fall in either of the axial directions, since the fall-preventive units are provided to face the sides of the rocker arm, the rocker arm comes into contact with either of the fall-preventive units, whereby the fall of the rocker arm can be prevented. Therefore, since there is no risk that the rocker arm falls or comes off when the camshaft is assembled, the assembly of the camshaft which is disposed above the rocker arm can be facilitated, and moreover, there is no risk that cam surface of the cam is damaged by the rocker arm. As a result, a time required for assembling the camshaft can be reduced to thereby improve the assembling properties of the internal combustion engine with such a valve train.

Further, according to a second aspect of the invention, there is provided an internal combustion engine with a valve train, comprising:

a rocker arm having a proximal portion which is spherically supported by an oscillating support member and an operating portion abutting with an engine valve;

a camshaft having a cam adapted to be brought into sliding contact with the rocker arm and disposed above the rocker arm, wherein the engine valve is operated to open and close by the rocker arm which is oscillated by the cam which rotates together with the camshaft; and a fall-preventive unit provided on a member which face the cam and the rocker arm in an axial direction of the camshaft for preventing the fall of the rocker arm in the axial direction through the contact with the rocker arm, the fall-preventive unit projecting further in the axial direction toward the rocker arm than a surface of the member which faces the cam.

According to the construction, even in a case where the rocker arm is spaced away from the member which faces the cam and the rocker arm, the projection can be made to project close to the rocker arm by making use of the member. Then, in the event that the rocker arm which is supported on the spherical surface attempts to fall, the rocker arm come into contact with the projection, whereby the fall thereof can be prevented. Consequently, according to this construction, the following advantage can be provided. Namely, since the fall-preventive unit is provided on the member which faces the cam and the rocker arm in the axial direction, and moreover, since the fall-preventive unit projects further toward the rocker arm than the surface of the member which faces the cam, even in case the rocker arm is spaced relatively far away from the member in the axial direction, the fall of the rocker arm can be prevented with the simple construction in which the projection is made to project closer to the rocker arm by making use of the member which faces the cam and the rocker arm. Then, in case the rocker arm which is supported on the spherical surface attempts to fall in the axial direction, the rocker arm comes into contact with the projection situated close thereto, whereby the fall of the rocker arm can be prevented. Therefore, since there is no risk that the rocker arm falls or comes off at the time of assembling the camshaft, the assembly of the camshaft that is disposed above the rocker arm can be facilitated, and moreover, there is no risk that the cam surface of the cam is damaged by the rocker arm. As a result, a time required for assembling the camshaft can be reduced to thereby improve the assembling properties of the internal combustion engine with such a valve train.

Moreover, according to a third aspect of the invention, there is provided an internal combustion engine with a valve train, comprising:

a rocker arm having a proximal portion which is spherically supported by an oscillating support member and an operating portion abutting with an engine valve;

a camshaft having a cam adapted to be brought into sliding contact with the rocker arm and disposed above the rocker arm, wherein the engine valve is operated to open and close by the rocker arm which is oscillated by the cam which rotates together with the camshaft; and a fall-preventive unit provided in such a manner as to face only one side of the rocker arms in an axial direction of the camshaft for preventing the fall of the rocker arm in the axial direction through the contact with the rocker arm, wherein the center of gravity of the rocker arm is situated at a position where a moment is generated that tilts the rocker arm toward the one side.

According to the construction, in a state where the rocker arm which is supported on the spherical surface is slidably supported, in case the rocker arm tries to fall due to the generation of a moment attributed to the position of the center of gravity thereof, the rocker arm comes into contact with the fall-preventive unit which is only provided on the side to which the rocker arm try to fall, whereby the fall thereof can be prevented. Consequently, according to the invention, the following advantage can be provided. Namely, since the fall-preventive unit is provided in such a manner as to face only one side of the rocker arm in the axial direction and the center of gravity of the rocker arm is situated at a position where a moment is generated that tilts the rocker arm to the one side thereof in a state where the rocker arm which is in abutment with the engine valve is supported by the oscillating support member, even in a case where there is no space on the one side of the rocker arm in the axial direction for providing the fall-preventive unit, in the event that the rocker arm which is supported on the spherical surface tries to fall due to the generation of moment attributed to the position of the center of gravity thereof with the rocker arm being pivotally supported, the rocker arm comes into contact with the fall-preventive unit provided on the side thereof to which the rocker arm tries to fall, whereby the fall thereof can be prevented. Thus, since the weight of the internal combustion engine can be reduced when compared with one in which the fall-preventive units are provided on the sides of the rocker arms and there is no risk that the rocker arm falls or comes off when the camshaft is assembled, the assembly of the camshaft that is disposed above the rocker arm can be facilitated, and moreover, there is no risk that the cam surface of the cam is damaged by the rocker arm. As a result, a time required for assembling the camshaft can be reduced to thereby improve the assembling properties of the internal combustion engine with such a valve train.

An internal combustion engine with a valve train as set forth in any of the first to third aspect of the invention, wherein the fall-preventive unit faces an upper end portion of the rocker arm which faces the cam in a vertical direction.

According to the construction, since the fall-preventive unit comes into contact with the upper end portions or area in the vicinity thereof of the falling rocker arm which includes a location which is farthest away from the falling center and which faces the cam in a vertical direction, the degree of tilt of the rocker arms when it comes into contact with the fall-preventive unit can be reduced. Consequently, according to the fourth aspect of the invention, in addition to the advantages provided by the cited aspects of the invention, the following advantage can be provided. Namely, since the fall-preventive unit faces the upper end portion of the rocker arm which faces the cam in the vertical direction and this allows the fall-preventive unit to come into contact with the upper end portion or the area in the vicinity thereof of the rocker arm which includes the location which is farthest away from the falling center, the degree of tilt of the rocker arms when it comes into contact with the fall-preventive unit can be reduced. Thus, the assembly of the camshaft can further be facilitated, and the assembling properties of the internal combustion engine with such a valve train can be improved.

An internal combustion engine with a valve train as set forth in any of the first to fourth aspects of the invention, wherein the member on which the fall-preventive unit is provided is a bearing portion for rotatably supporting the camshaft, and wherein the fall-preventive unit is a projection which is integrally formed on a side of the bearing portion which faces the rocker arm in the axial direction.

According to the construction, since the projection is integrally formed on the bearing portion whose rigidity is reduced due to the formation of a bearing bore, the rigidity of the bearing portion can be increased. Consequently, according to the fifth aspect of the invention, in addition to the advantages provided by the cited aspects of the invention, the following advantage can be provided. Namely, since the fall-preventive unit is the projection which is integrally formed on the side of the bearing portion for rotatably supporting the camshaft which faces the rocker arm in the axial direction, the rigidity of the bearing portion can be increased by making use of the projection for preventing the fall of the rocker arm.

According a sixth aspect of the invention, there is provided an integral cam holder for an internal combustion engine which is fastened to a cylinder head, comprising:

a plurality of bearing portions being provided at intervals in an axial direction of a camshaft of a valve train for operating engine valves to open and close, for rotatably supporting the camshaft;

primary and secondary longitudinal frames situated at end portions of each of the bearing portions and extending in the axial direction while connecting the bearing portions which are adjacent to each other in the axial direction at first connecting portions, the primary and secondary longitudinal frames being integrally formed with each other, wherein a rocker arm of the valve train is disposed in a through space which is formed by being surrounded by the adjacent bearing portions and the primary and secondary longitudinal frames, and a partitioning portion connected to the primary and secondary longitudinal frames at second connecting portions between the adjacent bearing portions in such a manner as to be integrally formed with the primary and secondary longitudinal frames, for partitioning the through space in the axial direction to thereby form small through spaces.

According to the construction, the primary and secondary longitudinal frames are connected to each other by the partitioning portion between the respective pairs of adjacent bearing portions, and moreover, the partitioning portion is provided in such a manner as to partition the through space in which the rocker arm is provided to thereby form the small through spaces. Consequently, the first aspect of the invention provides the following advantages. Namely, since the primary and secondary longitudinal frames which are connected to the adjacent bearing portions of the cam holder are connected by the partitioning portion between the adjacent bearing portions, the rigidity of the cam holder can be increased without depending upon the form of the camshaft supporting member which is connected to the cam holder for rotatably supporting the camshaft. In addition, since the partitioning portion partitions the through space which is formed by being surrounded by the adjacent bearing portions and the primary and secondary longitudinal frames and in which the rocker arm is disposed in the axial direction to thereby form the small through spaces, an increase in weight of the cam holder can be suppressed which would otherwise take place due to the provision of the partitioning portion.

According to a seventh aspect of the invention, there is provided an integral cam holder for an internal combustion chamber as set forth in the sixth aspect of the invention, wherein a plurality of the rocker arms are disposed in the through space at intervals in the axial direction, and wherein the partitioning portion is disposed between the rocker arms which are adjacent to each other in the axial direction in such a manner as to overlap the rocker arms as viewed in the axial direction.

According to the construction, in forming the partitioning portion, a space can be utilized which is formed between the rocker arms of the plurality of rocker arms disposed between the adjacent bearing portions which are adjacent to each other in the axial direction. Consequently, according to the seventh aspect of the invention, the following advantage is provided in addition to the advantage provided by the sixth aspect of the invention. Namely, since the space can be utilized for the formation of the partitioning portion which is formed between the plurality of rocker arms disposed in the through space at intervals in the axial direction which are adjacent to each other in the axial direction by constructing the partitioning portion so as to be disposed between the plurality of rocker arms so disposed which are adjacent to each other in the axial direction in such a manner as to overlap the rocker arms as viewed in the axial direction, the enlargement of the cam holder in the axial direction thereof can be avoided which would otherwise take place due to the provision of the partitioning portion.

According an eighth aspect of the invention, there is provided an integral cam holder for an internal combustion chamber as set forth in the sixth aspect of the invention, wherein a fastening portion for fastening the cam holder to the cylinder head is formed at the second connecting portion between the primary longitudinal frame and the partitioning portion.

According to the construction, the number of fastening portions on the cam holder to the cylinder head can be increased. Consequently, according to the eighth aspect of the invention, in addition to the advantages provided by the cited aspects of the invention, the following advantage is provided. Namely, since the number of fastening portions on the cam holder to the cylinder head can be increased by forming the fastening portion for fastening the cam holder to the cylinder head at the second connecting portion between the primary longitudinal frame and the partitioning portion, the rigidity of the cam holder can be increased further.

According to a ninth aspect of the invention, there is provided an integral cam holder for an internal combustion engine as set forth in the sixth or seventh aspect of the invention, wherein a primary oil passage is formed in the primary longitudinal frame, wherein a fastening portion for fastening the cam holder to the cylinder head is formed at the first connecting portion between the primary longitudinal frame and the bearing portion or the second connecting portion between the primary longitudinal frame and the partitioning portion, wherein the fastening portion forms an oil feed passage adapted to communicate with the primary oil passage and to feed lubricating oil to a hydraulic lash adjuster which is mounted on the cylinder head in such a manner as to come into abutment with the rocker arm, and wherein the oil feed passage connects to a secondary oil passage formed in the cylinder head so as to communicate with the lash adjuster.

According to the construction, the sealing pressure at the connecting portion between the oil feed passage and the secondary oil passage is increased at the fastening portion where the oil feed passage and the secondary oil passage is connected by virtue of the fastening by a fastening member. Consequently, according to the ninth aspect of the invention, on top of the advantages provided by the cited aspects of the invention, the following advantage is provided. Namely, by the construction wherein the primary oil passage is formed in the primary longitudinal frame, wherein the oil feed passage for feeding lubricating oil to the lash adjuster is formed in the fastening portion formed at the first connecting portion between the primary longitudinal frame and the bearing portion or the second connecting portion between the primary longitudinal frame and the partitioning portion for fastening the cam holder to the cylinder head, and wherein the oil feed passage connects to the secondary oil passage at the fastening portion the sealing pressure at the connecting portion between the oil feed passage and the secondary oil passage is increased at the fastening portion where the oil feed passage and the secondary oil passage is connected by virtue of the fastening by the fastening member, and therefore, the sealing property of the oil feed passage for the lash adjuster at the connecting portion can be improved by making use of the fastening portion for fastening the cam holder to the cylinder head, this contributing to the improvement in the response in operation of the lash adjuster.

Note that when used in the specification the "axial direction" means the direction of the rotational axis of the camshaft.

DETAILED DESCRIPTION OF THE PREFERRED EMBODIMENTS

Referring to FIGS. 1 to 9, a first embodiment of the invention will be described below.

Referring to FIGS. 1 to 5, an internal combustion engine E to which the invention is applied is a compression ignition-type DOHC in-line four-cylinder internal combustion engine. The internal combustion engine E includes a cylinder block (not shown) in which four cylinders 1 are arranged in a row, a cylinder head 2 fastened to an upper surface of the cylinder block with head bolts B1 (refer to FIG. 6, as well) and a head cover 3 fastened to an upper surface of the cylinder head 2. The four cylinders 1 have combustion chambers comprising recessed portions formed in top surfaces thereof, in which pistons fit in such a manner as to reciprocate freely therein.

Figure 3:
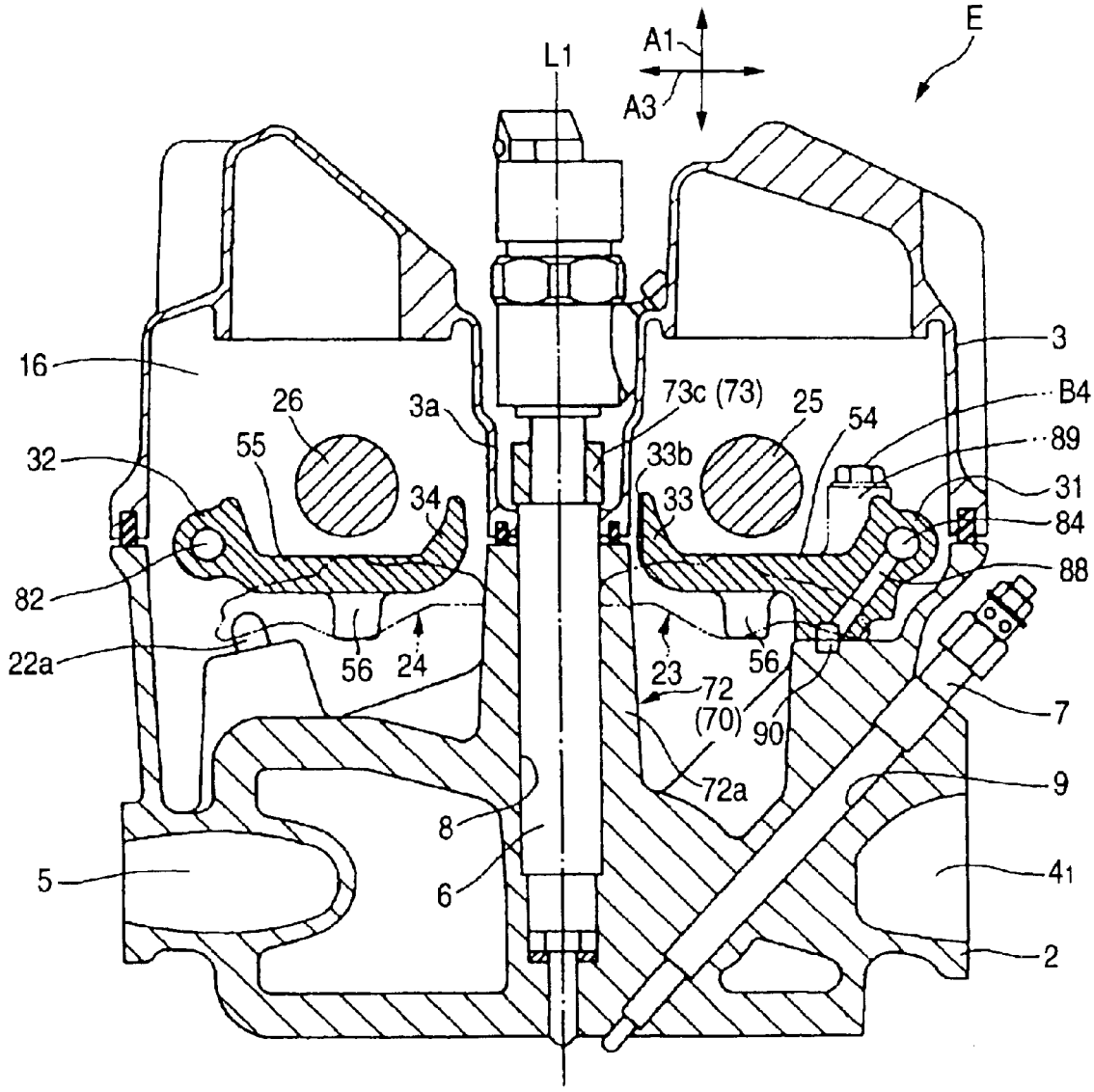
FIG. 3 is a sectional view taken along the line III—III in FIG. 1.

Formed in the cylinder head 2 for each cylinder 1 are a pair of independent first and second intake ports $\mathbf{4}_1$, $\mathbf{4}_2$ having intake port openings $\mathbf{4}_1$a, $\mathbf{4}_2$a which open to the interior of the cylinder 1 and a pair of independent exhaust ports 5 having exhaust port openings 5*a* which open to the interior of the cylinder 1. And, as shown in FIG. 3, formed additionally therein are an insertion hole 8 which is disposed co-axially with a cylinder axis L1 for insertion of a fuel injection valve 6 for injecting fuel into the combustion chamber and an insertion hole 9 for insertion of a glow plug 7 for heating compressed air.

Figure 5:
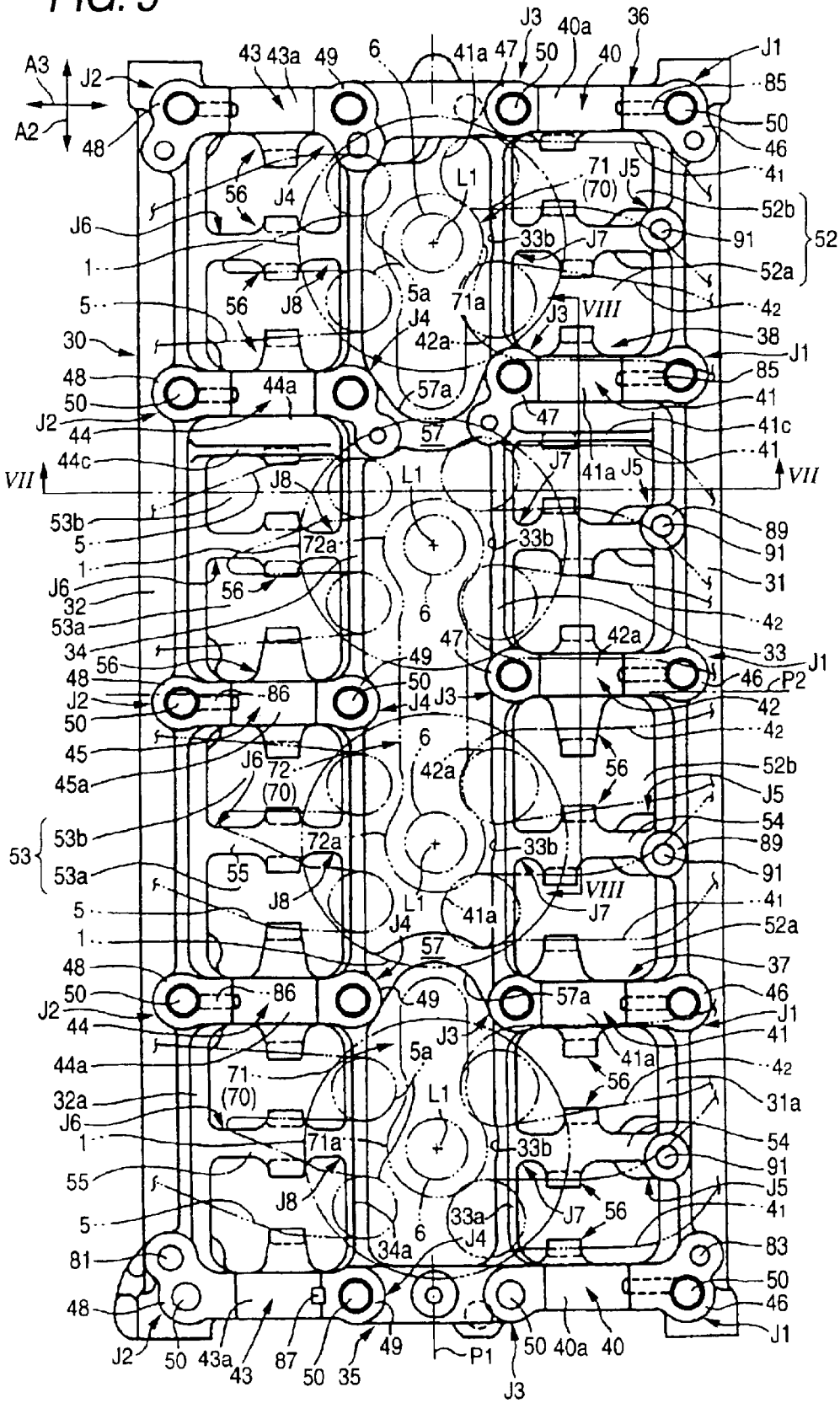
FIG. 5 is a top plan view of the lower cam holder of the internal combustion engine in FIG. 1.

Referring to FIG. 5, the first intake port $\mathbf{4}_1$ is constituted by a straight port for allowing intake air to flow into the cylinder 1 in a tangential direction thereof as viewed in the direction of the cylinder axis L1 (hereinafter, referred to as a "cylinder axis direction A1") so as to generate a swirl within the cylinder 1, and the second intake port $\mathbf{4}_2$ is constituted by a helical port for generating within the cylinder 1 an opposite swirl to the swirl generated by the first intake port $\mathbf{4}_1$. Then, an intake control valve is provided in an intake passage of an intake device which communicates with the first intake port $\mathbf{4}_1$, and this intake control valve opens and closes the intake passage so as to control the intensity of swirl generated in the cylinder 1 depending upon engine operating conditions such as engine speeds and engine loads.

Figure 4:
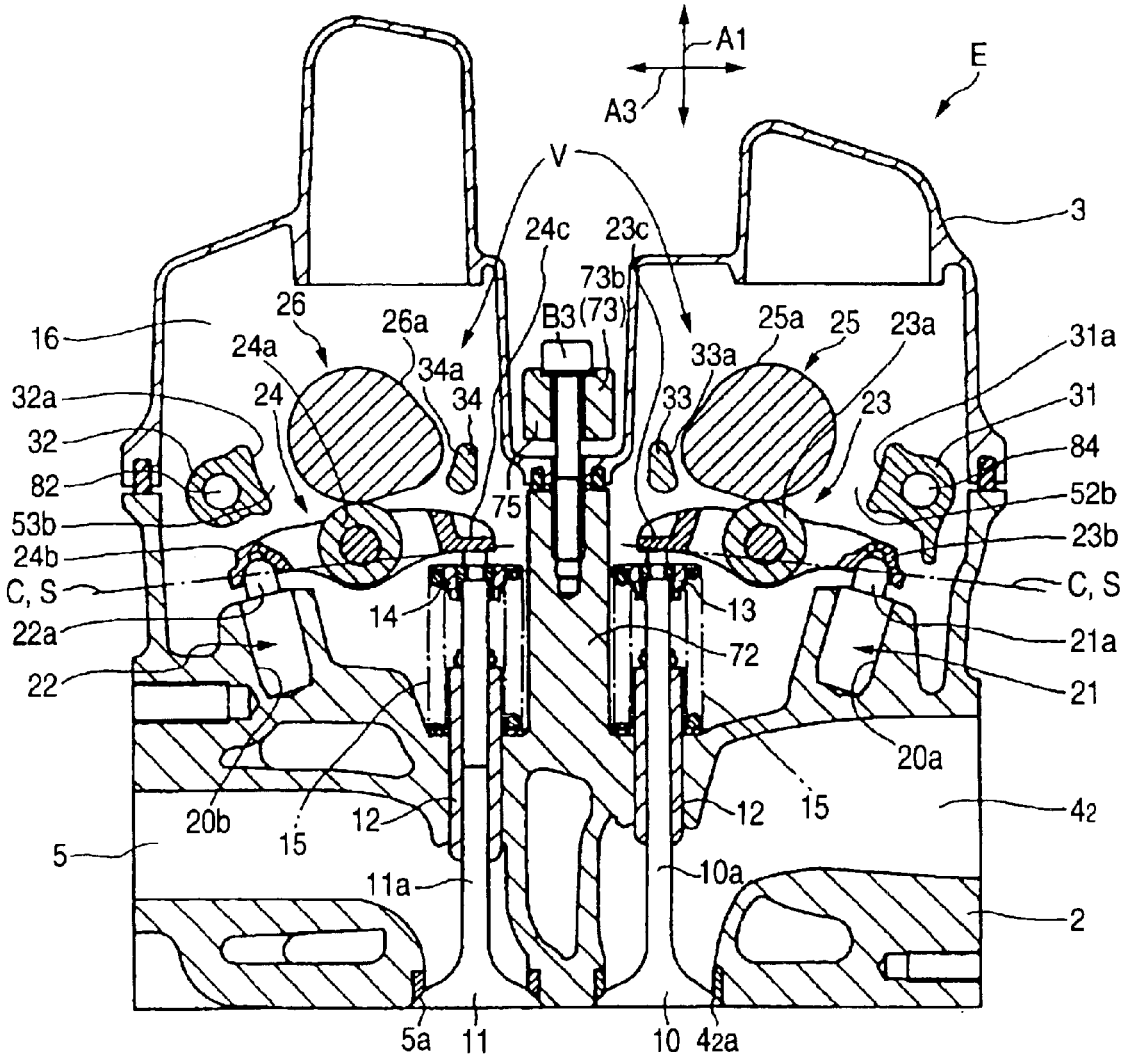
FIG. 4 is a sectional view taken along the line IV—IV in FIG. 1.

Referring to FIG. 4, in each cylinder 1, a pair of intake valves 10, which are engine valves, for opening and closing the pair of intake port openings $\mathbf{4}_1$a, $\mathbf{4}_2$a, respectively, and a pair of exhaust valves 11, which are engine valves, for opening and closing the pair of exhaust port openings 5*a*, respectively fit slidably in valve guides 12 fixed to the cylinder head 2. The intake valves 10 and the exhaust valves 11 are biased, respectively, in a direction in which they are closed by virtue of the spring-back force of valve springs 15 including compression coil springs which are disposed between spring brackets 13, 14 provided at tip portions of valve stems 10*a*, 11*a* and the cylinder head 2. Then, the respective intake valves 10 and respective exhaust valves 11 are operated to open and close by a valve train V accommodated within a valve train chamber 16 formed by the cylinder head 2 and the head cover 3.

A valve train V includes hydraulic lash adjusters 21, 22, intake rocker arms 23, exhaust rocker arms 24, an intake camshaft 25 and an exhaust camshaft 26. The hydraulic lash adjusters 21, 22 functions as oscillating support members adapted to be installed in receiving holes 20*a*, 20*b* formed in a cylinder head 2. The intake rocker arms 23 and exhaust rocker arms 24 have rollers 23*a*, 24*a* rotatably supported at central portions thereof, respectively. The intake camshaft 25 has intake cams 25*a* adapted to be brought into sliding contact with the rollers 23*a* and disposed above the intake rocker arms 23. The exhaust camshaft 26 has exhaust cams 26*a* adapted to brought into sliding contact with the rollers 24*a* and disposed above the exhaust rocker arms 24. The intake rocker arm 23, which extends on a plane which intersects at right angles with axes L1 of cylinders in a direction A3 (hereinafter, referred to as an "orthogonal direction") which intersects at right angles with the direction of rotational axes of the camshafts 25, 26 or an axial direction A2, is spherically supported on a support portion 21*a* of the lash adjuster 21 which has a spherical surface at a proximal portion 23*b* of the intake rocker arm 23 which is one end portion thereof and comes into abutment with a tip portion of a valve stem 10*a* of an intake valve 10 at an operating portion 23*c* of the intake rocker arm 23 which is the other end portion thereof. Similarly, the exhaust rocker arm 24, extending in the orthogonal direction A3, is spherically supported on a support portion 22*a* of the lash adjuster 22 which has a spherical surface at a proximal portion 24*b* of the exhaust rocker arm 24 which is one end portion thereof and comes into abutment with a tip portion of a valve stem 11*a* of an exhaust valve 11 at an operating portion 24*c* of the exhaust rocker arm 24 which is the other end portion thereof. Here, all intake rocker arms 23 and exhaust rocker arms 24 are designed to the same specifications.

The intake camshaft 25 and exhaust camshaft 26 which are rotatably supported on the cylinder head 2 via a cam holder H have rotational axes which are parallel with the rotational axis of a crankshaft of an internal combustion engine E and are driven to rotate at one-half crankshaft speed by the power of the crankshaft which is transferred thereto via a driving mechanism (not shown) The intake cams 25*a* and exhaust cams 26*a*, which rotate together with the intake camshaft 25 and exhaust camshaft 26, respectively, to be brought into sliding contact with the rollers 23*a*, 24*a*, operate corresponding intake valves 10 and exhaust valves 11 to open and close at predetermined timings according to cam profiles of cam surfaces thereof.

Figure 2:
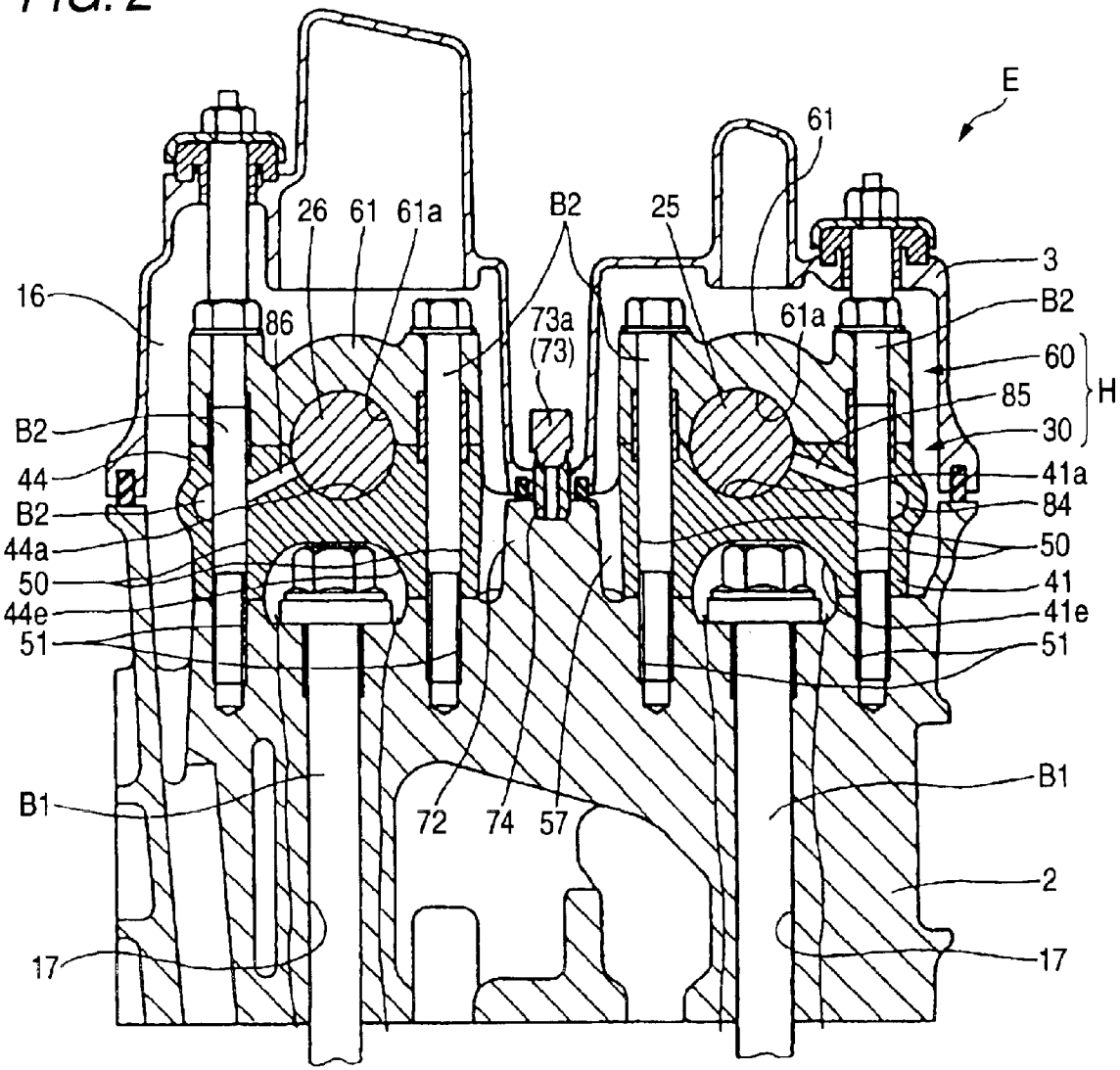
FIG. 2 is a sectional view taken along the line II—II in FIG. 1.

Referring to FIG. 2, the cam holder H provided in a valve train chamber 15 comprises a lower cam holder 30 which is fastened to the cylinder head 2 and an upper cam holder 60 which is fastened to the lower cam holder 30. The upper cam holder 60 is fastened to the cylinder head 2 together with the lower cam holder 30 with a plurality of bolts B2.

Referring to FIGS. 2, 3 and 5 to 8, the cam holder H will be described further below.

Figure 6:
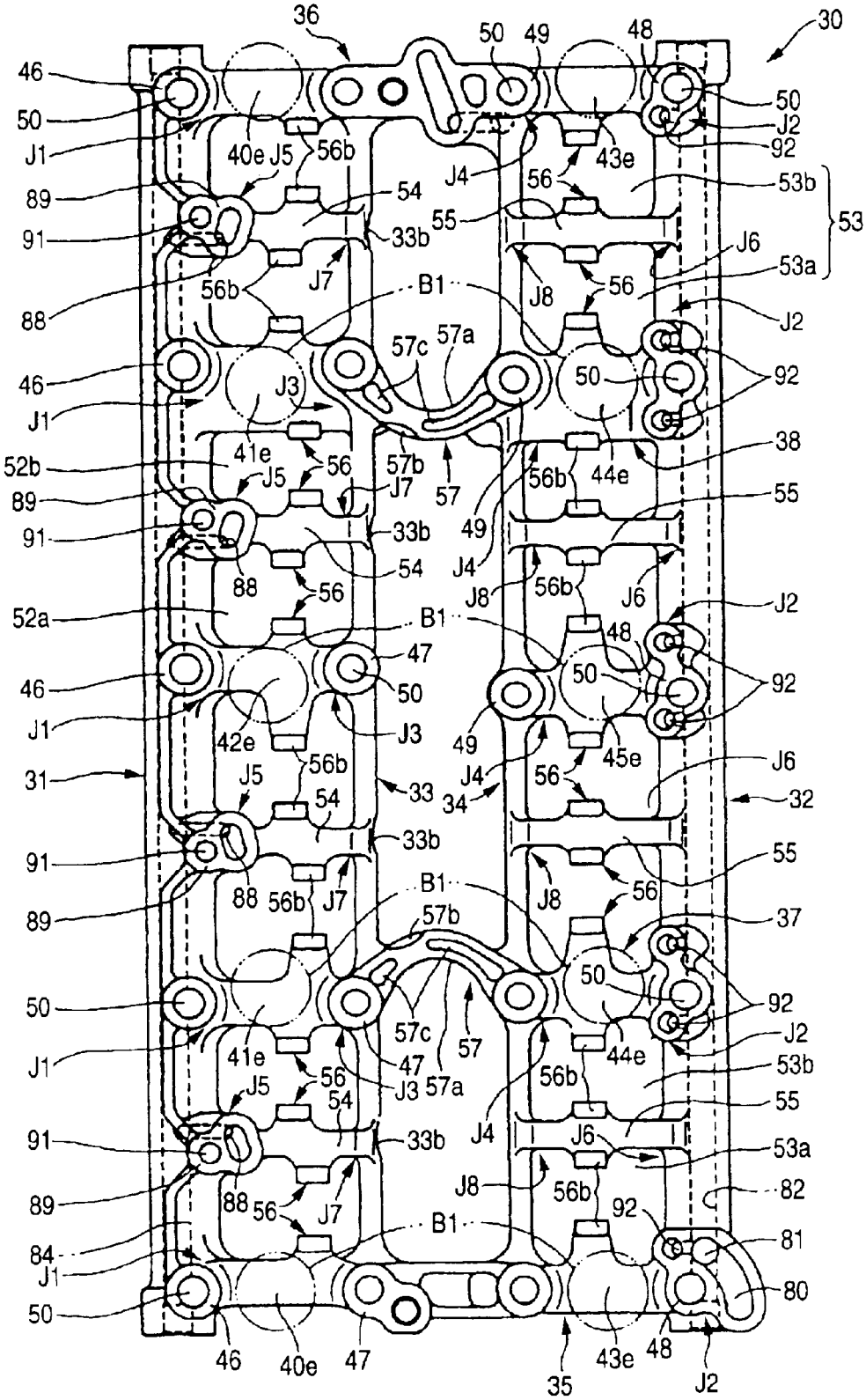
FIG. 6 is a bottom plan view of the lower cam holder of the internal combustion engine in FIG. 1.

Referring to FIGS. 5 and 6, the lower cam holder 30 is an integral cam holder having a frame structure and comprises longitudinal frames 31 to 34 which extend in the axial direction A2 and transverse frames 35 to 38 which connect to the longitudinal frames 31 to 34 and extend in the orthogonal direction A3. The longitudinal frames 31 to 34 include the outer longitudinal frames 31, 32 acting as a pair of primary longitudinal frames disposed in the orthogonal direction A3 at an interval and the inner longitudinal frames 33, 34 acting as a pair of secondary longitudinal frames which are closer to a primary center plane P1 which is a plane including the axes L1 of the respective cylinders than the outer longitudinal frames 31, 32. The outer longitudinal frames 31, 32 and the inner longitudinal frames 33, 34 are parallel with each other. The transverse frames 35 to 38, which are formed integrally with the longitudinal frames 31 to 34, include a pair of end transverse frames 35, 36 which connect together end portions of the respective outer and inner longitudinal frames 31 to 34 in the axial direction A2 at positions in the axial direction A2 which correspond to end portions of a row of four cylinders 1 in the axial direction A2 and two intermediate transverse frames 37, 38 which are between the end transverse frames 35, 36 and adjacent to the end transverse frames 35, 36, respectively, at intervals in the axial direction A2 and connect the outer and inner longitudinal frames 31 to 34.

Five bearing portions 40 to 42 for rotatably supporting the intake camshaft 25 are formed between the outer longitudinal frame 31 and the inner longitudinal frame 33 which are situated on an intake side of the lower cam holder H relative to the primary center plane P1 thereof where the intake valves 10 are situated. The five bearing portion 40 to 42 are integrally formed with the outer longitudinal framed 31 and the inner longitudinal frame 33 by being connected thereto at connecting portions J1, J3 which act as first connecting portions in such a manner as to be disposed in the axial direction A2 at intervals and to extend in the orthogonal direction A3 in parallel with one another. Similarly, five bearing portions 43 to 45 for rotatably supporting the exhaust camshaft 26 are formed between the outer longitudinal frame 32 and the inner longitudinal frame 34 which are situated on an exhaust side of the lower cam holder H relative to the primary center plane P1 thereof where the exhaust valves 11 are situated. The five bearing portions 43 to 45 are integrally formed with the outer longitudinal frame 32 and the inner longitudinal frame 34 by being connected thereto at connecting portions J2, J4 which act as the first connecting portions in such a manner as to be disposed in the axial direction A2 at intervals and to extend in the orthogonal direction A3 in parallel with one another.

The five bearing portions 40 to 42, 43 to 45 on each of the intake and exhaust sides comprise two end bearing portions 40; 43 which are formed on the end transverse frames 35, 36, respectively, two primary intermediate bearing portions 41; 44 which are formed on the intermediate transverse frames 37, 38, respectively, and one secondary intermediate bearing portion 42; 45 which is situated at the center in the axial direction A2 between the primary intermediate bearing portions 41; 44. The end bearing portions 40; 43 on the intake and exhaust sides are disposed at positions which correspond to the end portions of the row of cylinders in the axial direction A2, and the primary and secondary intermediate bearing portions 41, 42; 44, 45 are disposed at positions which are situated between the adjacent cylinders 1 in the axial direction A2. Bosses 46 to 49 acting as fastening portions having through holes 50 through which the bolts B2 (refer to FIG. 2) are passed are formed in the connecting portions J1, J3; J2, J4 between the outer longitudinal frames 31; 32 and the inner longitudinal frames 33; 34 which are situated at end portions of the respective bearing portions 40 to 42; 43 to 45 in the orthogonal direction A3. The bolts B2 which are passed through the through holes 50 screw into threaded holes 51 (refer to FIGS. 2, 9) formed in the cylinder head 2, so that the lower cam holder 30 is fastened to the cylinder head 2. In addition, projections 41*c*; 44*c* (refer to FIG. 8 as well) having recessed portions in which thrust plates (refer to FIG. 1) formed integrally on the intake camshaft 25 and the exhaust camshaft 26, respectively, fit to restrict the movement of the respective camshafts 25, 26 in the axial direction A2 are formed on one of the primary intermediate bearing portions 41, 44 (the upper primary intermediate bearing portions 41, 44 in FIG. 5) in such a manner as to extend between the outer longitudinal frame 31; 32 and the inner longitudinal frame on either of the intake and exhaust sides.

On the other hand, the upper cam holder 60 is connected to both the end transverse frames 35, 36 and comprises two end cam holders (not shown) having end bearing portions which correspond to the end bearing portions 40, 43 and intermediate cam holders 61 which constitute six bearing portions adapted to be connected to the primary and secondary intermediate bearing portions 41, 42, 44, 45, respectively. The respective end cam holders and respective intermediate cam holders 61 are fastened together with the lower cam holder 30 to the cylinder head 2 with the bolts B2 which are passed through the through holes 50.

Then, bearing grooves 40*a* to 45*a* which constitute bearing bores for rotatably supporting journal portions of the respective camshafts 25, 26 are formed between the outer longitudinal frame 31, 32 and the inner longitudinal frame 33, 34 at the respective bearing portions 40 to 45 of the lower cam holder 30 in cooperation with the end bearing portions of the upper cam holder 60 and bearing grooves 61*a* formed in the intermediate cam holders 61 when the upper cam holder 60 is fastened onto the lower cam holder 30. Then, the respective bearing grooves 40*a* to 42*a*, 43*a* to 45*a* on the lower cam holder 30 have wall surfaces comprising cylindrical surfaces which constitute bearing surfaces, and similarly, the respective bearing grooves on the upper cam holder 60 have wall surfaces comprising cylindrical surfaces which constitute bearing surfaces.

Furthermore, an accommodating space 52 for accommodating therein partially two intake rocker arms 23 which are disposed at an interval in the axial direction A2 and two intake cams 25*a* and an accommodating space 53 for accommodating therein partially two exhaust rocker arms 24 which are disposed at an interval in the axial direction A2 and two exhaust cams 26*a* are formed for each cylinder 1 by being surrounded by the bearing portions 40, 41; 41, 42; 43, 44; 44, 45 which are adjacent to each other in the axial direction A2 and the outer longitudinal frames 31, 32 and the inner longitudinal frames 33, 34. The respective accommodating spaces 52, 53 open to lower and upper surfaces of the lower cam holder 30 to thereby constitute through spaces which penetrate through the lower cam holder 30 in the axial direction A1 of the cylinder. In addition, as shown in FIG. 7, sides 31*a* to 34*a* of the outer longitudinal frames 31, 32 and the inner longitudinal frames 33, 34 which face the accommodating spaces 52, 53 are formed into concave shapes which follows the rotational loci of the respective cams 25*a*, 26*a*.

Then, the respective accommodating spaces 52, 53 are divided into two small through spaces which are small accommodating spaces 52*a*, 52*b*; 53*a*, 53*b*, respectively, by partitioning portions 54; 55 which extend in the orthogonal direction A3 in such a manner as to be in parallel with the respective bearing portions 40 to 45 and which are integrally formed with the outer longitudinal frames 31; 32 and the inner longitudinal frames 33; 34 by being connected thereto at connecting portions J5, J7; J6, J8 which act as second connecting portions. And, part of one of the intake rocker arms 23 or part of one of the exhaust rocker arms 24 is accommodated in each of the small accommodating spaces 52*a*, 52*b*; 53*a*, 53*b*. Consequently, the partitioning portions 54, 55 are disposed between the rocker arms 23, 24 which are disposed adjacent to each other in the axial direction in such a manner as to overlap the rocker arms so disposed (refer to FIG. 3). Then, the bearing portions 40 to 45 and the partitioning portions 54, 55 which face each other in the axial direction A2 with the rocker arms 23, 24 accommodated in the respective small accommodating spaces 52*a*, 52*b*; 53*a*, 53*b* being held therebetween are members which are adapted to face each other in the axial direction A2 with certain gaps being provided relative to both sides of the rocker arm 23, 24 in the axial direction A2.

As shown in FIGS. 5 and 6, projections 56 are integrally formed on the respective bearing portions 40 to 45, as well as the respective partitioning portions 54, 55 in such a manner as to project in the axial directions A2 from the sides thereof which face the small accommodating spaces 52*a*, 52*b*; 53*a*, 53*b*, respectively, toward the rocker arms 23, 24. Among those projections 56, projections 56 provided on the bearing portions 40 to 45 project further in the axial directions A2 than the sides which include as part thereof the confronting sides which confront the intake cam 25*a* or the exhaust cam 26*a* in the axial direction A2 (in FIG. 7, sides 41*b*, 44*b* and confronting sides 41*b*1, 44*b*1 of the bearing portions 41, 44 are shown as representative of the bearing portions 40 to 45). Furthermore, as shown in FIGS. 2, 7 and 8, the entirety of the respective projections 56 of the bearing portions 40 to 45 or most parts of the respective projections 56 are provided within a range in the orthogonal direction A3 where the bearing grooves 40*a* to 45*a* are formed, and therefore, the projections are formed at portions of the bearing portions 40 to 45 where the thickness thereof is reduced in the axial direction A1 of the cylinders.

Figure 7:
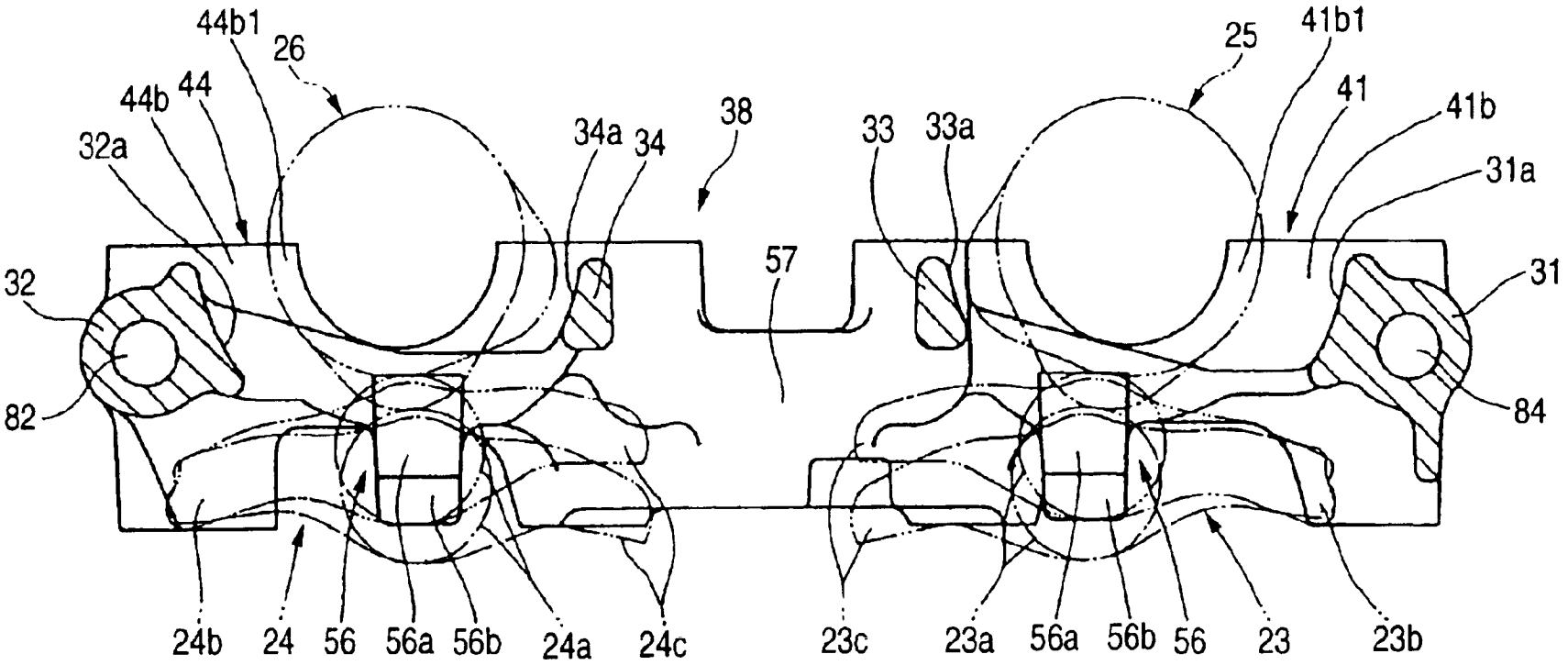
FIG. 7 is a sectional view taken along the line VII—VII in FIG. 5.

Then, referring to FIG. 7 in which the positions of the rocker arms 23, 24 when the intake valve and the exhaust valve 11 are closed are shown in two-dot chain lines, while the positions of the rocker arms 23, 24 when the intake valve 10 and the exhaust valve 11 are lifted to their maximum heights are shown in alternate long and short dash lines, each projection 56 has a restricting surface 56*a* and a guide surface 56*b*. The restricting surface 56*a* includes a plane which is situated at a central portion of the rocker arm 23, 24 so as to face in the axial direction A2 the roller 23*a*, 24*a* which forms a portion of the rocker arm 23, 24 which has a maximum width in the axial direction A1 of the cylinder and which intersects at right angles with the rotational axis of the camshaft 25, 26. The guide surface 56*b* includes an inclined plane which continues to a lower end of the restricting surface 56*a* and recedes from the restricting surface 56*a* toward the cylinder head 2 therebelow so as to come closer to the side of the bearing portions 40 to 45 or the partitioning portions 54, 55 where the restricting surface 56*a* is provided and which is in parallel with the orthogonal direction A3.

Figure 8:
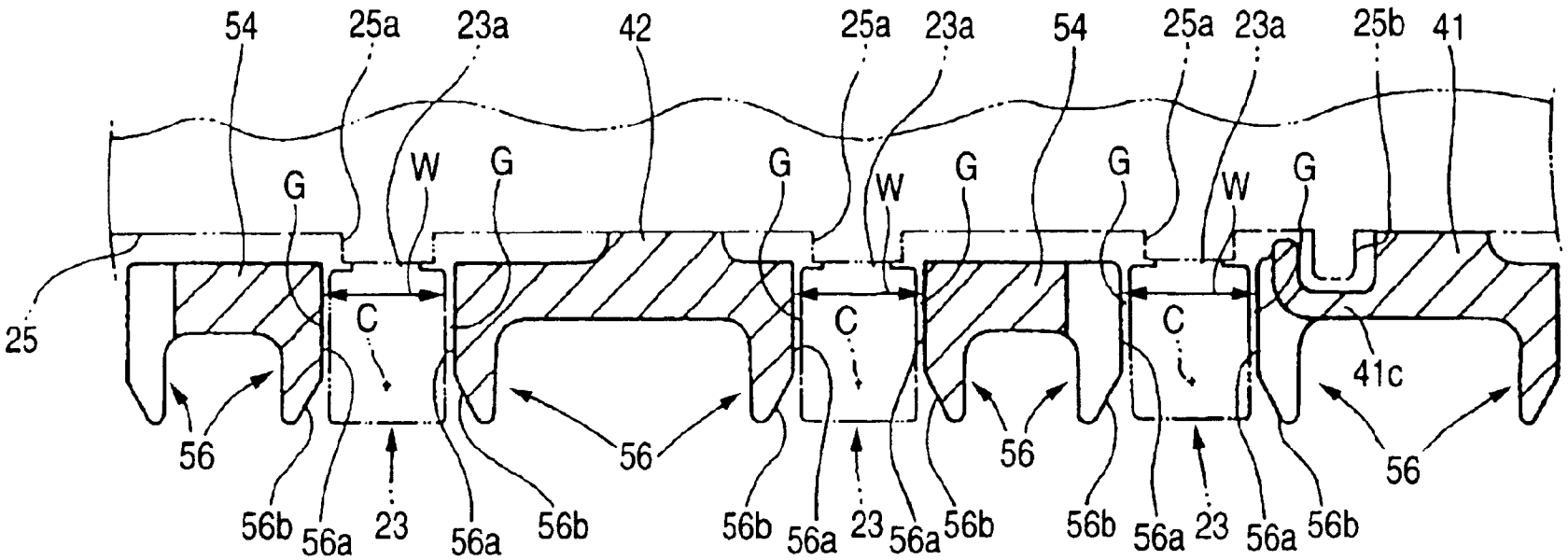
FIG. 8 is a sectional view taken along the line VIII—VIII in FIG. 5.

Referring to FIG. 8 as well, the restricting surfaces 56*a* of pairs of projections 56 provided on the bearing portions 40 to 45 and the partitioning portions 54, 55 in such a manner as to face each other with the rocker arm 23, 24 being held therebetween are provided in such a manner as to face sides of the rocker arms 23, 24 in the axial direction A2 with a slight predetermined gap G being secured therebtween when the rocker arms 23, 24 are assembled to the cylinder head 2 in such a manner that the proximal portions 23*b*, 24*b* thereof are spherically supported on the support portions 21*a*, 22*a*, while the operating portions 23*c*, 24*c* thereof are brought into abutment with the intake valves 10 or exhaust valves 11 with the rocker arms 23, 24 accommodated in the small accommodating spaces 52*a*, 52*b*, 53*a*, 53*b* occupying positions set in advance or positions where the rocker arms 23, 24 do not tilt (in FIG. 8, only the intake rocker arm 23 is shown, but this is true with the exhaust rocker arm 24) as when the cams 25*a*, 26*a* of the camshafts 25, 26 assembled to the cylinder head 2 are in abutment with the rollers 23*a*, 24*a* of the rocker arms 23, 24, and the lower cam holder 30 is assembled to the cylinder head 2 at a predetermined position so that the through holes 50 and the threaded holes 51 are brought into alignment with each other. In addition, an interval between the guide surfaces 56*b* of the pairs of the facing protrusions 56 in the axial direction A2 is equal to an interval W in the axial direction A2 between the restricting surfaces 56*a* thereof at the minimum and increases as the guide surfaces 56*b* extend so as to come closer to the cylinder head 2 (or downwardly). In addition, the gap G is restricted by a predetermined angle, which will be described later.

In assembling the lower cam holder 30 to the cylinder head 2 from the above of the rocker arms 23, 24 which have already been assembled to the cylinder head 2, for example, in the event that the rocker arms 23, 24 tilt or deviate from the preset positions to such an extent that they cannot be accommodated within the intervals W between the pairs of restricting surfaces 56*a*, the respective guide surfaces 56*b* are designed to guide the rocker arms 23, 24 such that the rocker arms 23, 24 can be accommodated within the intervals W between the restricting surfaces 56*a* by rectifying the deviation by allowing the rocker arms 23, 24 to first come into contact with the guide surfaces 56*b* which are spaced away from each at wider intervals in the axial direction A2 than the interval W between the restricting surfaces 56*a* as the lower cam holder 30 approaches the cylinder head 2, so that the rocker arms 23, 24 are eventually accommodated within the intervals W between the restricting surfaces 56*a*.

Then, in a state where the lower cam holder 30 is assembled to the predetermined position on the cylinder head 2, in the event that the rocker arms 23, 24 attempt to tilt about falling center lines C (refer to FIG. 4, as well) from the preset positions, after tilting through a predetermined angle relative to the gaps G, the rocker arms 23, 24 come into contact with the restricting surfaces 56*a* of the projections 56, whereby the rocker arms 23, 24 are prevented from tilting larger than the predetermined angle or falling down. Note that the predetermined angle is an angle through which the rocker arms 23, 24 which have tilted due to the contact between the respective cams 25*a*, 26*a* and the rollers 23*a*, 24*a* which occurs when the respective camshafts 25, 26 are assembled are corrected so that the rocker arms 23, 24 can occupy the preset positions. In addition, even if the rocker arms 23, 24 are on a tilt in a state where the lower cam holder 30 has been assembled to the predetermined position, while the camshafts 25, 26 have not yet been assembled, the tilt should be equal to or less than the predetermined angle. Therefore, the respective projections 56 constitute fall-preventive unit for preventing the fall of the rocker arms 23, 24 in the axial direction A2 by virtue of the contact with the rocker arms 23, 24.

Here, to describe the falling center line C with reference to FIG. 4, the falling center line C is a line connecting the oscillating centers of the support portions 21*a*, 22*a* and the abutment portions of the operating portions 23*c*, 24*c* with the valve stems 10*a*, 11*a* and a center line of the rotation of the rocker arms 23, 24 when they tilt in the axial direction A2 from the preset positions in a state where the rocker arms 23, 24 are assembled to the cylinder head 2 in such a manner that the proximal portions 23*b*, 24*b* are spherically supported on the support portions 21*a*, 22*a* and the operating portions 23*c*, 24*c* come into abutment with the intake valves 10 or the exhaust valves 11, and the rollers 23*a*, 24*a* are not in contact with the cams 25*a*, 26*a*. Consequently, when the rocker arms 23, 24 rotate around the falling center lines C from the preset positions, the tilt of the rocker arms 23, 24 in the axial direction A2 is generated.

Then, referring to FIGS. 7 and 8, the restricting surface 56 is situated on the camshaft 25, 26 side which is above a plane S (in FIG. 4, shown as overlapping the falling center line C) including the falling center lines C of the rocker arms 23, 24 and being parallel with the axial direction A2 and faces the rocker arm 23, 24 in the axial direction A2 at a location of the rocker arm 23, 24 which is most distant from the plane S or, in this embodiment, a range including the abutment portion of the roller 23*a*, 24*a* with the intake cam 25*a* or the exhaust cam 26*a*.

In addition, since an intake port opening $\mathbf{4}_1$a of a first intake port $\mathbf{4}_1$ is situated closer to the primary center plane P1 than a second intake port opening $\mathbf{4}_2$a of a second intake port $\mathbf{4}_2$ and the rocker arms 23 (refer to FIG. 1) adapted to come into abutment with the intake valves 10 which open and close the intake port openings $\mathbf{4}_1$a, $\mathbf{4}_2$a which are offset from each other in the orthogonal direction are designed to the same specification, as shown in FIGS. 5 and 6, the projections 56 for preventing the fall of the intake rocker arm 23 which comes into abutment with the intake valve 10 which opens and closes the intake port opening $\mathbf{4}_1$a are situated closer to the primary center plane P1 than the projections 56 for preventing the fall of the intake rocker arm 23 which comes into abutment with the intake valve 10 which opens and closes the intake port opening $\mathbf{4}_2$a. On the other hand, the projections 56 on the exhaust side where exhaust port openings 5*a* are aligned linearly in the axial direction A2 are all situated in linear alignment in the axial direction A2.

Figure 1:
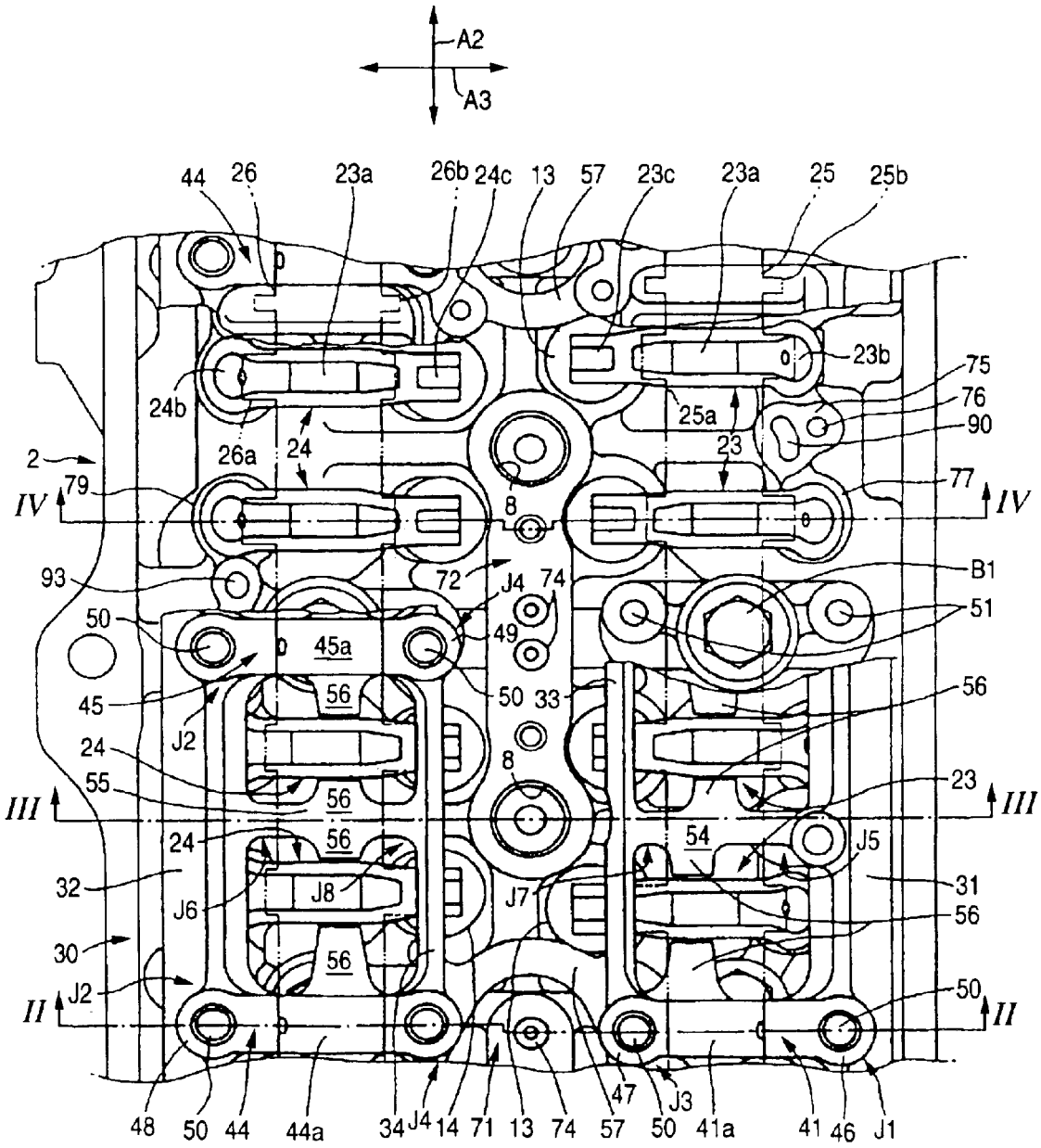
FIG. 1 is a top plan view showing a main part of a cylinder head of an internal combustion engine according to a first embodiment of the invention, with rocker arms and a lower cam holder being assembled to the cylinder head.

Referring to FIGS. 5 and 6, the respective intermediate transverse frames 37, 38 have, between the pair of inner longitudinal frames 33, 34, connecting portions 57 which are contiguous with bosses 47, 49 of the primary intermediate bearing portions 41, 44 and which each includes a curved wall constituting a recessed portion 57*a* on a side thereof which faces the end transverse frame 35, 36. As shown in FIGS. 1 and 5, mount portions 70 for fuel injection valves 6 are integrally formed on the cylinder head 2 in such a manner as to project in the axial direction A1 of the cylinders between both the inner longitudinal frames 33, 34 in a state where the lower cam holder 30 and the upper cam holder 60 are assembled to the cylinder head 2. The mount portions 70 where insertion holes 8 (refer to FIG. 3) into which the fuel injection valves 6 are inserted are formed are situated between the end transverse frames 35, 36 and the connecting portions 57, respectively. The mount portions 70 include two end mount bosses 71 whose end portions which are closer to the connecting portions 57 are received in the recessed portions 57*a* of the connecting portions 57, respectively (refer to FIG. 1) and a central mount boss 72 situated between both the connecting portions 57. One fuel injection valve 6 is fixed in each of the end mount bosses 71 with a clamp 73 (refer to FIGS. 2 to 4) and two fuel injection valves 6 are fixed in the central mount boss 72 with clamps 73. To be specific, the clamp 73 is placed on a cylindrical fulcrum portion 74 (refer to FIG. 2) fixed to an upper surface of each mount boss 71, 72 at one end portion 73*a* thereof, and a pressing portion 73*c* which has a bifurcated configuration on the other end thereof presses against the fuel injection valve 6 by being tightened at a central portion 73*b* thereof with a bolt B3, whereby the fuel injection valve 6 is secured to the cylinder head 2. Then, those four fuel injection valves 6 are disposed symmetrically relative to a secondary center plane P2 (refer to FIG. 5) which passes through the center line of the row of cylinders in the axial direction A2.

Then, as shown in FIGS. 3 and 5, curved concave portions 33*b* are formed in a side of the intake-side inner longitudinal frame 33 which is closer to the primary center plane P1 for avoiding interference with pillar-like portions 71*a*, 72*a* where the fuel injection valve 6 insertion holes 8 of the respective mount bosses 71, 72 are formed and insertion cylinders 3*a* formed in the head cover 3 for insertion of the fuel injection valves 6.

In addition, as shown in FIG. 6, a concave portion 57*b* is formed in a lower surface of the connecting portion 57 for receiving therein a spring bracket 13 of the intake valve 10 which opens and closes the intake port opening $4_1$a and furthermore, lightening portions 57*c* are formed in the lower surface except for a portion thereof which is situated in the vicinity of the concave portion 57*b*, whereby the cylinder head 2 can be made compact. Moreover, since the lightening portions 57*c* are formed except for the portion in the vicinity of the concave portion 57*b*, not only can the required rigidity of the connecting portion 57 be secured but also the weight thereof can be reduced.

Next, referring to FIGS. 3, 5, 6 and 9, oil passages will be described which are formed in the lower cam holder 30 and the cylinder head 2. Referring to FIG. 6, an oil passage 80 having a groove connecting to an oil passage 95 (refer to FIG. 9) formed in the cylinder head 2 at a joint between the cylinder head 2 and the lower cam holder 30 is formed in the vicinity of a boss 48 formed in a connecting portion J2 between the outer longitudinal frame 32 on the exhaust side and the end transverse frame 35. The oil passage 80 communicates with an oil passage 82, acting as a primary oil passage, which comprises a hole formed in the exhaust-side outer longitudinal frame 32 and a communicating oil passage formed in the end cam holder which is the upper cam holder 60 adapted to be connected to the end transverse frame 35 via an oil passage 81 which extends upwardly in the lower cam holder 30. The communicating oil passage communicates with an oil passage 84, acting as the primary oil passage, which has a hole formed in the intake-side outer longitudinal frame 31 via an oil passage (refer to FIG. 5) connected at a joint between the end transverse frame 35 and the end cam holder.

Then, as shown in FIG. 5, oil passages 85 communicating with the oil passage 84 via oil passages formed by radial gaps between the through holes 50 and the bolts B2 open in the bearing surfaces of the bearing portions 40 to 42 which support the intake camshaft 25 (refer to FIG. 2, as well). Further, oil passages 86 communicating with an oil passage 82 via oil passages formed by radial gaps between the through holes 50 and the bolts B2 open in the bearing surfaces of the bearing portions 43 to 45 which support the exhaust camshaft 26 except for the bearing portion 43 at the end transverse frame 35 (refer to FIG. 2, as well). With these structure, lubricating oil is supplied to the bearing surfaces of the bearing portions 40 to 45 through these oil passages 85, 86. In addition, lubricating oil from the communicating oil passage is supplied to the bearing surface of the bearing portion 43 at the end transverse frame 35 via an oil passage 87 consisting of an oil groove.

Referring to FIGS. 3 and 6, bosses 89 forming oil passages 88 communicating with the oil passage 84 in the intake-side outer longitudinal frame 31 are formed at connecting portions J5 between the respective partitioning portions 54 and the outer longitudinal frame 31. These oil passages 88 are connected, respectively, to oil passages 90, acting as secondary oil passages, which are formed in the cylinder head 2 in such a manner as to communicate with intake-side lash adjusters 21 at joints between bosses 75 formed on the cylinder head 2 and the bosses 89 (refer to FIGS. 1 and 9).

Figure 9:
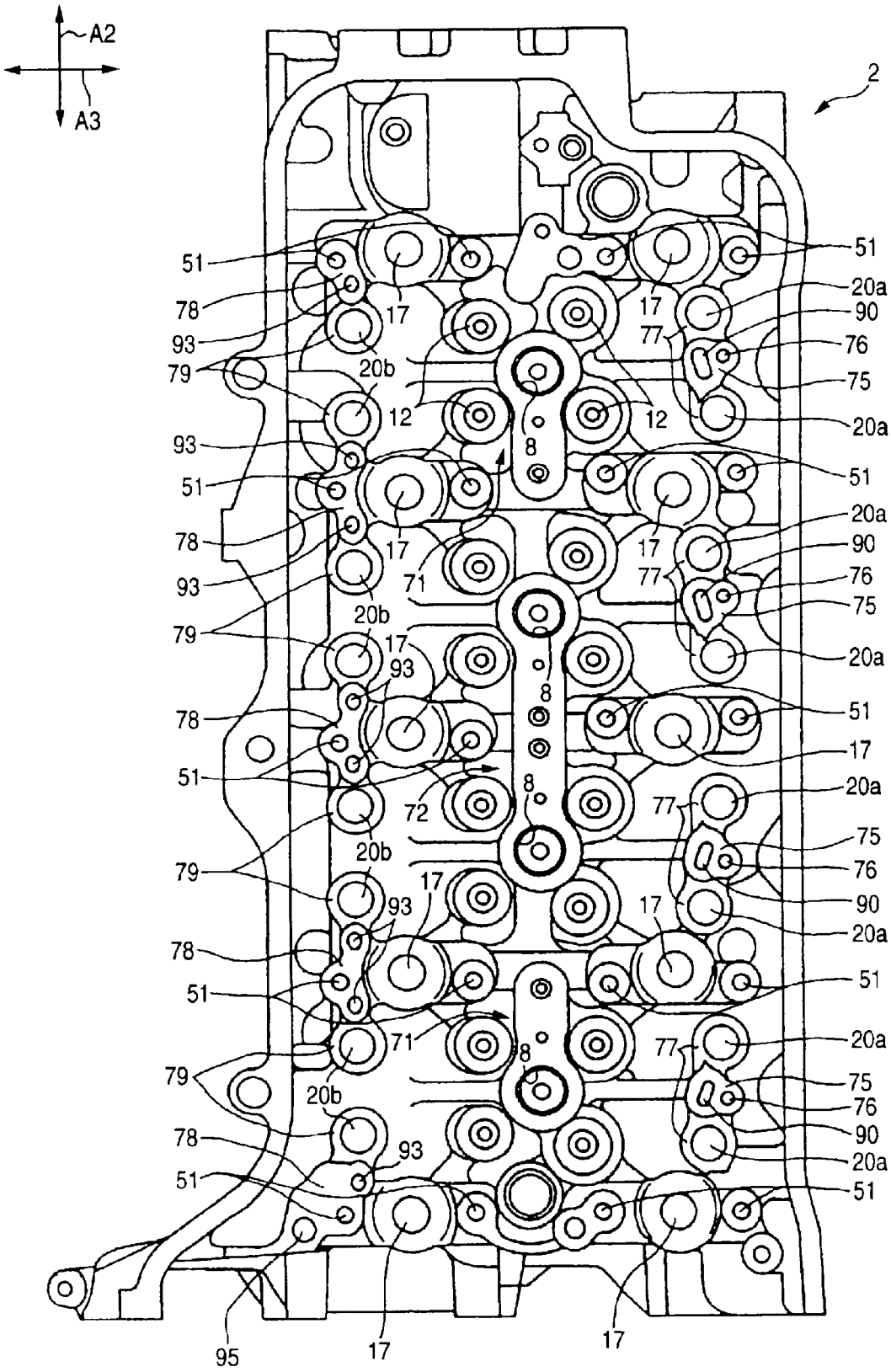
FIG. 9 is a top plan view of the cylinder head.
Figure 10:
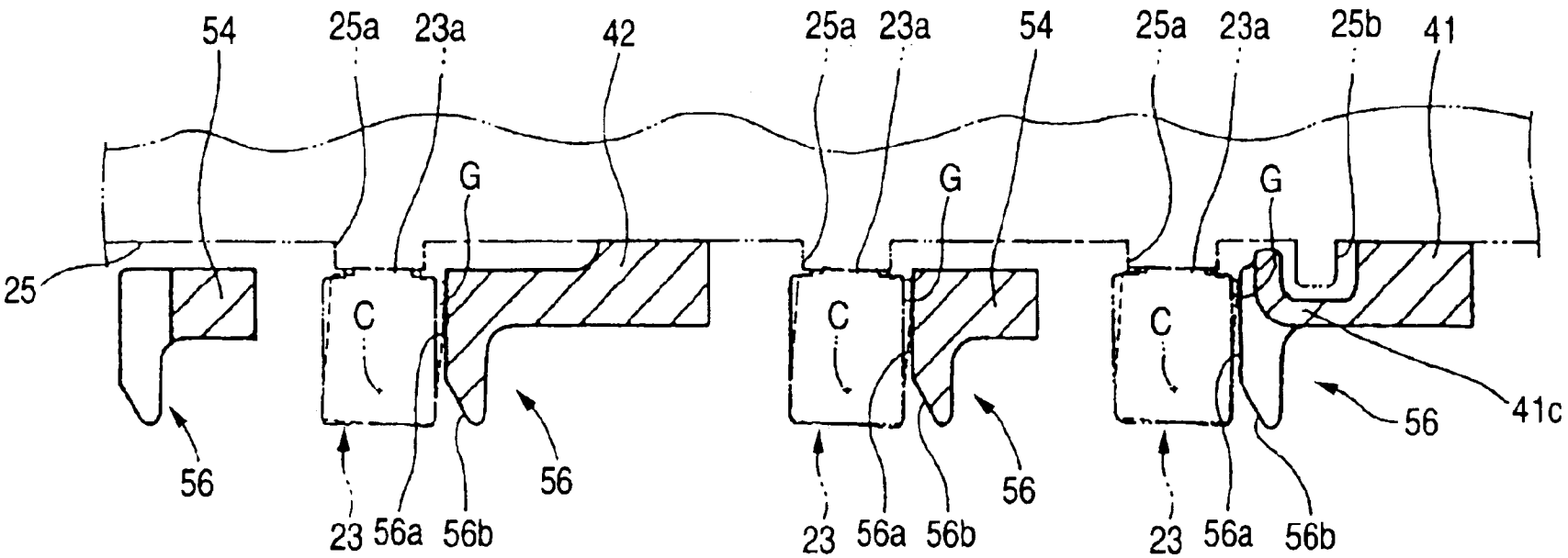
FIG. 10 is a sectional view showing an internal combustion engine according to a second embodiment, which corresponds to FIG. 8 showing the first embodiment.

As shown in FIG. 9, accommodating holes 20*a* for accommodating the intake-side lash adjusters 21 are formed in bosses 77 which are contiguous with the boss 75 on sides thereof in the axial direction A2. Then, the bosses 89 on the lower cam holder 30 are tightened to the bosses 75 with bolts B4 (refer to FIG. 3) which pass through through holes 91 formed in the bosses 89 so as to screw into threaded holes 76 formed in the cylinder head 2, whereby the sealing pressure at the joints between both the bosses 89 and 75 where the oil passages 88 and 90 are connected together is increased, thereby making it possible to prevent the leakage of lubricating oil. Therefore, the bosses 89 are fastening portions for fastening the lower cam holder 30 to the cylinder head 2. In addition, lubricating oil, which is hydraulic oil, is supplied to the respective lash adjusters 21 through these oil passages 88, 90. Thus, the oil passages 88 are oil feed passages formed in the lower cam holder 30 for feeding lubricating oil to the lash adjusters 21.

On the other hand, oil passages 92 communicating with the oil passage 82 in the outer longitudinal frame 32 on the exhaust side are formed one in the vicinity of each of the bosses 48 at the respective end bearing portions 40, 43, and two in the vicinity of each of the bosses 48 at the respective intermediate bearing portions 41, 42, 44, and 45. These oil passages 92 connect, respectively, to oil passages 93 which are the secondary oil passages formed in the cylinder head 2 in such a manner as to communicate with the lash adjusters 22 on the exhaust side at joints between bosses 78 formed on the cylinder head 2 and the bosses 48 (refer to FIGS. 1 and 9).

As shown in FIG. 9, accommodating holes 20*b* for accommodating therein the exhaust-side lash adjusters 22 are formed in bosses 79 which are contiguous with bosses 78 on sides thereof in the axial direction. Then, the bosses 48 on the lower cam holder 30 are tightened to the bosses 78 with bolts B2 (refer to FIG. 2) which pass through the through holes 50 to screw into the threaded holes 51 in the cylinder head 2, whereby the sealing pressure at the joints between both the bosses 48, 78 where both the oil passages 92, 93 are connected to each other is increased, a leakage of lubricating being thereby prevented. Then, lubricating oil as hydraulic fluid is supplied to the respective lash adjusters 22 through the oil passages 92, 93. Thus, the oil passages 92 are oil feed passages formed in the lower cam holder 30 for feeding lubricating oil to the lash adjusters.

In addition, as shown in FIGS. 2 and 6, recessed portions 40*e* to 45*e* for accommodating heads of head bolts B1 which are passed through the through holes 17 (refer to FIG. 9, as well) in the cylinder head 2 are provided on lower surfaces of the respective bearing portions 40 to 45, which are surfaces on the cylinder head 2 side, between the respective bearing portions 40 to 45 and the cylinder head 2. Since this allows the bearing portions 40 to 45 and the head bolts 1 to be disposed in such a manner as to overlap each other in the axial direction A2, the width of the cylinder head 2 in the axial direction A2 can be reduced.

Next, the function and effectiveness of the embodiment that is constructed as has been described heretofore will be described.

In assembling the respective camshafts 25, 26 to the cylinder head 2, firstly, the respective rocker arms 23, 24 are assembled to the cylinder head 2 in such a manner that the proximal portions 23*b*, 24*b* are spherically supported on the support portions 21*a*, 22*a* of the lash adjusters 21, 22 and the operating portions 23*c*, 24*c* are brought into abutment with the tip portions of the valve stems of the intake valves 10 or the exhaust valves 11. Thereafter, the lower cam holder 30 is assembled to the upper surface of the cylinder head 2 at the predetermined position from above the cylinder head 2. When assembling the lower cam holder 30 to the cylinder head 2, even if the rocker arms 23, 24 and the lower cam holder 30 deviate in the axial direction A2 to such an extent that the rocker arms 23, 24 are not accommodated in the intervals W formed in the axial direction A between the restricting surfaces 56*a* due to, for example, the rocker arms 23, 24 tilting larger than the predetermined angle or the lower cam holder 30 deviating from the predetermined position in the axial direction A2 prior to the assembly thereof to the cylinder head, the rocker arms 23, 24 come into abutment with the guide surfaces 56*b* within the maximum interval range of the guide surfaces 56 and are then guided so as to be placed between the restricting surfaces 56 as the lower cam holder 30 is moved downwardly. Then, when the lower cam holder 30 is assembled to the cylinder head 2 at the predetermined position the respective rocker arms 23, 24 are situated between the pairs of restricting surfaces 56*a* in the respective small through spaces 52*a*, 52*b*, 53*a*, 53*b*.

Following this, the camshafts 25, 26 are positioned at the bearing portions 40 to 45 from above the rocker arms 23, 24 and the lower cam holder 30 in such a manner that the respective cams 25*a*, 26*a* come into abutment with the rollers 23*a*, 24*a* of the corresponding rocker arms 23, 24 and the journal portions of the respective camshafts 25, 26 fit in the bearing grooves 40*a* to 45*a* of the corresponding bearing portions 40 to 45, and furthermore, the end cam holders and the intermediate cam holders are placed on the bearing portions 40 to 45 and are then fastened together with the lower cam holder 30 to the cylinder head 2 with the bolts B2, whereby the assembly of the camshafts 25, 26 to the cylinder head 2 is completed.

Then, provided on the lower cam holder 30 are the intermediate transverse frames 37, 38 for connecting together the outer longitudinal frames 31, 32 and the inner longitudinal frames 33, 34, as well as the inner longitudinal frames 33, 34 to which the primary and secondary intermediate bearing portions are connected at their one end portions, whereby the rigidity of the lower cam holder 30 is increased. In particular, the provision of the inner longitudinal frames 33, 34 secures a required rigidity for the secondary intermediate bearing portions 44, 45 which are not connected to each other.

Furthermore, on the lower cam holder 30, the outer longitudinal frames 31, 32 and the inner longitudinal frames 33, 34 which are connected to the bearing portions 40, 41; 41, 42; 43, 44; 44, 45 which are adjacent in the axial direction A are connected to each other by the partitioning portions 54, 55 which extend in parallel with the bearing portions 40 to 45 between the adjacent bearing portions 40, 41; 41, 42; 43, 44; 44, 45, whereby the rigidity of the lower cam holder 30 is increased irrespective of the fact that the upper cam holder 60, which is a camshaft support member adapted to be connected to the lower cam holder 30, consists of the separate intermediate cam holders 61 on the intake and exhaust sides except for the end cam holders. In addition, the partitioning portions 54, 55 are formed by being surrounded by the adjacent bearing portions 40, 41; 41, 42; 43, 44; 44, 45 and the outer longitudinal frames 31, 32 and the inner longitudinal frames 33, 34 and are provided in such a manner as to partition the accommodating spaces 52, 53 in which the rocker arms 23, 24 are disposed in the axial direction A2 to thereby form the two small accommodating spaces 52*a*, 52*b*, 53*a*, 53*b* in each of the accommodating spaces 52, 53 so partitioned. Thus, the increase in weight of the lower cam holder 30 due to the provision of the partitioning portions 54, 55 is suppressed.

In addition, the pairs of projections 56 are provided in such a manner as to face each other on the sides in the axial direction A of the rocker arms 23, 24 which are pivotally supported at the proximal portions 23*a*, 24*a* thereof which are, in turn, supported on the spherical surfaces of the lash adjusters 21, 22, whereby when assembling the camshafts 25, 26 from above the rocker arms 23, 24 which are already assembled to the cylinder head 2, even if the rocker arms 23, 24, which are supported on the spherical surfaces attempt to fall in either of the axial directions A2, the rocker arms 23, 24 come into abutment with either of the projections 56, and the fall of the rocker arms 23, 24 is prevented. Thus, since there is no risk that the rocker arms 23, 24 fall or come off at the time of assembling the camshafts 25, 26, the assembly of the camshafts 25, 26 which are disposed above the rocker arms 23, 24 assembled to the cylinder head 2 can be facilitated. Moreover, there is no risk that the cam surfaces of the cams 25*a*, 26*a* are damaged by the rocker arms 23, 24. As a result, a time required for assembling the camshafts 25, 26 can be reduced, and the assembling properties of the internal combustion engine E with the valve train can be increased. Thus, the provision of the partitioning portions 54, 55 can increase the rigidity of the lower cam holder 30, and on top of that, the provision of the projections 56 on the partitioning portions 54, 55 can prevent the fall in the axial directions A2 of the rocker arms 23, 24 which tend to tilt in the axial directions A2 of the camshafts 25, 26. Consequently, the assembly of the camshafts 25, 26 from above the rocker arms 23, 24 can be facilitated, whereby the assembling properties of the internal combustion engine E with the lower cam holder 30 can also be increased.

The respective projections 56 are provided on the bearing portions 40 to 45 and the partitioning portions 54, 55 which are members facing the cams 25*a*, 26*a* and the rocker arms 23, 24 in the axial direction A2, and moreover, the projections 56 project from the surfaces of those members which face the cams 25*a*, 26*a* toward the sides in the axial direction A2 of the rocker arms 23, 24, whereby even if the rocker arms 23, 24 are spaced away relatively largely from the bearing portions 40 to 45 and the partitioning portions 54, 55 in the axial directions A2, the fall of the rocker arms 23, 24 can be prevented with the simple construction in which the projections 56 are allowed to project to the positions close to the rocker arms 23, 24 by making use of the members facing the cams 25*a*, 26*a* and the rocker arms 23, 24.

In the rocker arms 23, 24 which are falling about the falling center line C, the projections 56 face in the axial direction the upper end portions of the rollers 23*a*, 24*a* of the rocker arms 23, 24 which are situated closer to the camshafts 25, 26 side than the plane S including the falling center lines C and expanding in parallel with the axial direction A2 and are spaced farthest away from the plane S and which face the cams 25*a*, 26*a* in a vertical direction, this allowing the projections 56 to be brought into contact with the locations of the rocker arms 23, 24 which are spaced farthest away from the plane S including the falling center lines C or areas in the vicinity of the locations, whereby it is possible to reduce the extent of tilt of the rocker arms 23, 24 when the rocker arms 23, 24 come into abutment with the projections 56 or an correctable extent of tilt of the rocker arms 23, 24 in which the rocker arms 23, 24 which are caused to tilt due to the contact of the respective cams 25*a*, 26*a* with the rollers 23*a*, 24*a* at the time of assembling the respective camshafts 25, 26 can be corrected to occupy the preset positions. Thus, the assembly of the camshafts 25, 26 can further be facilitated, and the assembling properties of the internal combustion engine E with the valve train V can be increased.

The projections 56 are integrally formed on the bearing portions 40 to 45 which rotatably support the camshafts 25, 26 within the range in the direction normal to the axial direction A2 as viewed from the top where the bearing grooves 40*a* to 45*a* of the bearing portions 40 to 45 are formed, and this allows the projections 56 to be provided on the sides of the bearing portions where the rigidity is lowered due to the reduced thickness resulting from the formation of the bearing grooves 40*a* to 45*a* which constitute the bearing bores, whereby the rigidity of the bearing portions 40 to 45 is increased. As a result, the rigidity of the bearing portions 40 to 45 can be increased by making use of the projections 56 for preventing the fall of the rocker arms 23, 24.

In addition, the end portions of the mount bosses 71, 72 where the fuel injection valves 6 are mounted are accommodated in the recessed portions 57*a* of the connecting portions 57, whereby the length of the lower cam holder 30 in the axial direction A2 can be reduced, and the lower cam holder 30 can be made compact in the axial direction A2. Furthermore, there exists no connecting portion between both the inner longitudinal frames 33, 34 for connecting the secondary intermediate bearing portions 42, 45 on the intake and exhaust sides, this allowing the common mount boss 72 for mounting two fuel injection valves 6 to be disposed between both the connecting portions 57, whereby the cylinder head 2 can be made compact in the axial direction A2 when compared with a cylinder head in which a mount boss is provided for each cylinder.

The oil passages 82, 84 are formed in the respective outer longitudinal frames 31, 32 for supplying lubricating oil to the lash adjusters 21, 22, and since this increases the rigidity, the rigidity of the lower cam holder 30 can be increased. Moreover, the rigidity of the lower cam holder 30 can further be increased by the formation of the oil passages 82, 84 in the outer longitudinal frames 31, 32 of the four longitudinal frames 31 to 34.

Furthermore, the guide surfaces 56*b* are provided on the projections 56 which each comprise the inclined plane which recedes from the restricting surface 56*a* to be closer to the side of the bearing portion 40 to 45 or the partitioning portion 54, 55 where the restricting surface 56 is provided and which is in parallel with the orthogonal direction A3, and the interval in the axial direction A2 between the pair of the guide surfaces 56*b* which face each other with the rocker arm 23, 24 being held therebetween is set such that the interval is equal to the interval W between the restricting surfaces 56*a* at the minimum and increases as the guide surfaces 56*b* extend toward the cylinder head 2, whereby even if the rocker arms 23, 24 and the lower cam holder 30 deviate in the axial direction A2 to such an extent that the rocker arms 23, 24 are not accommodated within the intervals W between the pairs of restricting surfaces 56*a* when the lower cam holder 30 is assembled to the cylinder head 2 from above the rocker arms 23, 24 which are already assembled to the cylinder head 2, the rocker arms 23, 24 come into contact with the guide surfaces 56*b* within the maximum interval range of the guide surfaces 56 and are then guided so as to be placed between the restricting surfaces 56*a* as the lower cam holder 30 is moved to be closer to the cylinder head 2. As a result, all the rocker arms 23, 24 are allowed to be situated between the restricting surfaces 56*a* of the pairs of projections 56 when the lower cam holder 30 is fastened to the cylinder head with the bolts, thereby increasing the assembling properties of the lower cam holder 30 to the cylinder head 2 from above the rocker arms 23, 24 which are so assembled to the cylinder head 2 and are so disposed on the lower cam holder 30 at the predetermined position with respect to the rocker arms 23, 24.

The partitioning portions 54; 55 are disposed within the accommodating spaces 52*a*, 52*b*; 53*a*, 53*b* at intervals in the axial direction A2 in such a manner as to overlap the rocker arms 23, 24 as viewed in the axial direction A2. Thus, since the spaces formed between the pairs of adjacent rocker arms 23; 24 can be utilized, the enlargement in the axial direction A2 of the lower cam holder can be avoided which would otherwise occur due to the provision of the partitioning portions 54, 55.

The bosses 89 through which the bolts B4 are passed to fasten the lower cam holder 30 to the cylinder head 2 are formed at the connecting portions 75 between the intake-side outer longitudinal frame 31 and the partitioning portions 54, 55, whereby the number of fastening portions for fastening the lower cam holder 30 to the cylinder head 2 can be increased in addition to the bosses 46 to 49 which are formed at the connecting portions J1 to J4, thereby making it possible to increase further the rigidity of the lower cam holder 30.

The oil passages 84, 82 are formed in both the outer longitudinal frames 31, 32, and the oil passages 88, 92 for feeding lubricating oil to the lash adjusters 21, 22 are formed in the bosses 89, 48 which are formed at the respective connecting portions J5, J2 with the outer longitudinal frames 31, 33 for connecting lower cam holder 30 to the cylinder head 2, and the oil passages 88, 92 are connected with oil passages 90, 93, respectively, at the bosses 89, 48, whereby the sealing pressure at the connecting portions between the oil passages 88, 92 and the oil passages 90, 93 is increased by virtue of tightening with the bolts B4, B2. Thus, the sealing properties at the connecting portions of the oil passages 88, 92 to the lash adjusters 21, 22 can be increased by making use of the bosses 89, 48 for fastening the lower cam holder 30 to the cylinder head 2, this contributing to the improvement in the operation response of the lash adjusters.

The sides 31*a* to 34*a* of the outer longitudinal frames 31, 32 and the inner longitudinal frames 33, 34 which are situated to face the accommodating spaces 52, 53 are formed into the concave shapes which follow the rotational loci of the rotating cams 25*a*, 26*a*, whereby since the intervals in the orthogonal direction A3 between both the longitudinal frames 31 to 34 can be reduced while avoiding the interference between the longitudinal frames 31 to 34 and the cams 25*a*, 26*a*, the width in the orthogonal direction A3 of the lower cam holder 3 and hence the width in the same direction of the cylinder head 2 can be reduced.

Next, a second embodiment of the invention will be described. In contrast to the first embodiment in which the pairs of projections 56 are disposed on the sides of the rocker arms 23, 24 in the axial direction A2, in this second embodiment, as shown by projections 56 on the intake side which are partially shown in FIG. 9, projections 56 are provided so as to face only one side in the axial direction A2 of the respective rocker arms 23, 24. Note that like reference numerals are to be given to members like or corresponding to those described in the first embodiment.

Here, the centers of gravity of the rocker arms 23, 24 are set to be situated at positions where moments acting to tilt the rocker arms 23, 24 to come closer to the one side about the falling center lines C when the rocker arms 23, 24 are not in contact with the cams 25*a*, 26*a* in a state where the rocker arms 23 which abut with the intake valves 10 and the rocker arms 24 which abut with the exhaust valves 11 are pivotally supported on the respective lash adjusters 21, 22, or, for example, positions which are offset by a predetermined distance to the side where the projections 56 are provided relative to the falling center lines C. Then, in a state where the respective rocker arms 23, 24 are assembled to the cylinder head 2, the rocker arms 23, 24 occupy the set positions through the contact with the cams 25*a*, 26*a* at a point in time of assembly of the camshafts 25, 26.

Furthermore, in the second embodiment, the lower cam holder 30 is positioned on the cylinder head 2 with positioning pins for preliminary fixation thereon prior to assembly of the rocker arms 23, 24 to the cylinder head 2. Then, the respective rocker arms 23, 24 are assembled onto the cylinder head 2 from above the lower cam holder 30 through the respective small accommodating spaces 52*a*, 52*b*; 53*a*, 53*b* which provide larger spaces than those of the first embodiment due to the provision of the projections 56 only on the one side in the axial direction A2 of the respective bearing portions 40 to 45 and the respective partitioning portions 54, 55 to thereby facilitate the insertion of the rocker arms 23, 24 in such a manner that the proximal portions 23*b*, 24*b* thereof are spherically supported on the support portions 21*a*, 22*a* of the lash adjusters 21, 22 and the operating portions 23*c*, 24*c* thereof abut with the tip portions of the valve stems 10*a* of the intake valves 10 or the valve stems 11*a* of the exhaust valves 11. As this occurs, while the rocker arms 23, 24 tilt about the falling center lines C due to the generation of moments attributed to the positions of the centers of gravity thereof, the rocker arms 23, 24 come into contact with the restricting surfaces 56*a* of the projections 56 within the range of the predetermined angle to thereby prevent the fall of the rocker arms 23, 24. This condition is shown by broken lines in FIG. 9. As this occurs, in case all the rocker arms 23, 24 are made to the same specification, while the positions of the projections 56 provided on the bearing portions 40 to 45 and the partitioning portions 54, 55 become opposite in the axial direction A2 between the intake and exhaust sides, the projections 56 can be provided on the same sides in the axial direction by utilizing rocker arms 23, 24 of difference specifications.

The other constructions of the second embodiment are basically identical to those of the first embodiment, and after the rocker arms 23, 24 have been assembled to the cylinder head as has been described above, the camshafts 25, 26 are assembled to the cylinder head 2 from above the rocker arms 23, 24 and the lower cam holder 30 as in the same manner as used in the first embodiment.

Consequently, according to the second embodiment, the following advantage can be provided. Namely, since the projections 56 are provided so as to face only the one side in the axial direction A2 of the rocker arms 23, 24 and the centers of gravity of the rocker arms 23, 24 are situated at the positions where the moments are generated which act to tilt the rocker arms 23, 24 to come closer to the one side in the state where the rocker arms 23, 24 which abut with the intake valves 10 or the exhaust valves 11 are supported on the lash adjusters, even in the event that no space is available on one side of the rocker arms 23, 24 in the axial direction A2 for providing projections 56, when the rocker arms 23, 24 which are supported on the spherical surfaces try to fall due to the generation of moments attributed to the positions of the centers of gravity thereof at the time of assembly thereof to the cylinder head 2, the rocker arms 23, 24 come into contact with the projections 56 provided on the side to which they are trying to fall to thereby prevent the fall of the rocker arms 23, 24. Thus, when compared with the case where the projections 56 are provided on both the sides of the rocker arms 23, 24, the weight of the internal combustion engine E can be reduced. In addition, since there is no risk that the rocker arms 23, 24 fall or come off at the time of assembly of the camshafts 23, 24, the assembly of the camshafts 25, 26 which are disposed above the rocker arms 23, 24 can be facilitated, and in addition, there is no risk that cam surfaces of the cams 25*a*, 26*a* are damaged by the rocker arms 23, 24. As a result, a time required for assembling the camshafts 25, 26 can be reduced, thereby making it possible to improve the assembling properties of the internal combustion engine E with such a valve train.

In addition, since the respective rocker arms 23, 24 are allowed to come into contact with the projections 56 in a more stable fashion by tilting the cylinder head 2 in such a manner that the projections 56 are situated below the respective rocker arms 23, 24 which are being assembled when the respective rocker arms 23, 24 are assembled to the cylinder head 2, the fall of the rocker arms 23, 24 can be prevented further securely.

Modified constructions of embodiments which are the results of partial modifications made to the embodiments that have been described heretofore will be described below.

Of the pairs of projections provided so as to face both the sides of the respective rocker arms 23, 24 in the axial direction A in the first embodiment, the projections 56 which face the one side of the respective rocker arms 23, 24 can be provided so as to be closer to the respective rocker arms 23, 24 than the projections 56 provided so as to the other side of the rocker arms 23, 24, and moreover, similarly to the second embodiment, the centers of gravity of the respective rocker arms 23, 24 can be situated at positions where moments are generated which act to tilt the rocker arms 23, 24 to the one side in a state where the respective rocker arms 23, 24 are supported spherically on the lash adjusters 21, 22.

According to the construction, since the tile of the respective rocker arms 23, 24 resulting in a stage where they are in contact with the projections 56 facing only the one side thereof can be made as small as possible and the space for assembling the respective rocker arms 23, 24 can be expanded, the assembling properties of the respective rocker arms 23, 24 to the cylinder head 2 can be improved while attempting to prevent the fall thereof, and moreover, since the tile of the respective rocker arms 23, 24 is small, the assembling properties of the camshafts 25, 26 can be bettered further.

In the respective previous embodiments, while the widths of the cams 25*a*, 26*a* in the axial direction A2 are set to be smaller than those of the rocker arms 23, 24 in the axial direction A2 as shown in FIGS. 8 and 9 and the rotational loci of the intake cams 25*a*, 26*a* are made to overlap the projections 56 as viewed in the axial direction A2, in a case where the rotational loci of the cams 25*a*, 26*a* do not overlap the projections 56 as viewed in the axial direction A2, the widths of the intake cams 25*a*, 26*a* in the axial direction A2 can be set to be larger than those of the rocker arms 23, 24.

One of the two end cam holders of the upper cam holder 60 which correspond to the end bearing portion 40 and the end bearing portion 43 which are formed on the end transverse frame 36 may be constituted by separate cam holders on the intake and exhaust sides as with the intermediate cam holders 61.

Furthermore, either of the two end cam holders of the upper cam holder 60 may be constituted by separate cam holders on the intake and exhaust sides as with the intermediate cam holders 61. Then, as this occurs, lubricating oil is supplied to the oil passages 84, 84 formed in both the outer longitudinal frames 31, 32 from separate oil passages formed in the cylinder head 2.

In addition, in the above embodiments, while the intermediate cam holders 61 of the upper cam holder 60 are separate on the intake and exhaust sides, the intermediate cam holders on the intake and exhaust sides may be integrated to constitute an integral holder as with the end cam holders of the upper cam holder 60, and according to this construction, the rigidity of the lower cam holder 30 and hence of the cam holder H can be increased further.

Thus, the upper cam holder 60 adapted to be fastened to the bearing portions 40 to 45 for rotatably supporting the intake camshaft 25 and the exhaust camshaft 26 may be constituted by the separate cam holders on the intake and exhaust sides or by the integral ones in which the cam holders on the intake and exhaust sides are made integral. In either of the cases, the rigidity of the lower cam holder 30 can be increased by the provision of the partitioning portions 54, 55.

In the original embodiment, while the bosses 48 which are the fastening portions where the oil passages 92 and the oil passages 93 are connected to each other are formed at the connecting portions J2 between the bearing portions 40 to 45 and the outer longitudinal frame 32 on the exhaust side, similarly on the intake side, fastening portions through which bolts are passed so as to screw into the cylinder head 2 may be formed at the connecting portions J6 between the partitioning portions 55 and the outer longitudinal frame 32, and the oil passages 92 and the oil passages 93 may be connected to each other at the fastening portions so formed.

In the respective embodiments, while there are provided a pair of intake valves 10 and a pair of exhaust valves 11 for each cylinder, at least either of the intake valves and the exhaust valves may be such that only one valve is provided for each cylinder. Furthermore, in the respective embodiments, while the bearing portions 40 to 45 are provided at the positions in the axial direction A2 which correspond to the end portions of the row of cylinders and the intermediate portions between the adjacent cylinders 1, they may be provided at positions in the axial direction A2 which correspond to central positions of the respective cylinders 1.

In addition, in the embodiments, while the internal combustion engine E is a DOHC engine, a SOHC engine may be used in which a single camshaft is provided for a row of cylinders. Furthermore, three or more rocker arms 23, 24 may be disposed at intervals in the axial direction A2 in each of the accommodating spaces 52, 53.

In the respective embodiments, while the internal combustion engine is the compression ignition-type engine, a spark ignition-type engine may be used. In addition, while the oscillating support members for spherically supporting the rocker arms 23, 24 are the hydraulic lash adjusters 21, 22, mechanical lash adjusters using adjusting screws or those having no such adjusting mechanism may be used.

What is claimed is:

1. An internal combustion engine with a valve train, comprising:

a rocker arm having a proximal portion which is spherically supported by an oscillating support member and an operating portion abutting with an engine valve;

a camshaft having a cam adapted to be brought into sliding contact with said rocker arm and disposed above said rocker arm, wherein said engine valve is operated to open and close by said rocker arm which is oscillated by said cam which rotates together with said camshaft, wherein said camshaft is supported in a cam holder fastened to a cylinder head; and a fall-preventive unit for preventing the fall of said rocker arm in an axial direction of said camshaft through the contact with said rocker arm, wherein said cam holder forms an integral cam holder which integrally includes a plurality of bearing portions provided at intervals in said axial direction of said camshaft, for rotatably supporting said camshaft, and a partitioning portion disposed between adjacent bearing portions;

wherein said fall-preventive unit comprises a plurality of fall-preventive units integrally provided on a respective one of said bearing portions and on said partitioning portion.

2. The internal combustion engine as set forth in claim 1, wherein said fall-preventive unit faces an upper end portion of said rocker arm which faces said cam in a vertical direction.

3. The internal combustion engine as set forth in claim 2, wherein said fall-preventive unit is a projection which is integrally formed on a side of a bearing portion for rotatably supporting said camshaft, said side of said bearing portion facing said rocker arm in said axial direction.

4. An internal combustion engine with a valve train, comprising:

a rocker arm having a proximal portion which is spherically supported by an oscillating support member and an operating portion abutting with an engine valve;

a camshaft having a cam adapted to be brought into sliding contact with said rocker arm and disposed above said rocker arm, wherein said engine valve is operated to open and close by said rocker arm which is oscillated by said cam which rotates together with said camshaft; and fall-preventive units provided in such a manner as to face both sides of said rocker arm in an axial direction of said camshaft, for preventing the fall of said rocker arm in said axial direction through the contact with said rocker arm, wherein each fall-preventive unit is a projection integrally formed on a side of a bearing portion for rotatably supporting said camshaft, said side of said bearing portion facing said rocker arm in said axial direction.

5. An internal combustion engine with a valve train, comprising:

a rocker arm having a proximal portion which is spherically supported by an oscillating support member and an operating portion abutting with an engine valve;

a camshaft having a cam adapted to be brought into sliding contact with said rocker arm and disposed above said rocker arm, wherein said engine valve is operated to open and close by said rocker arm which is oscillated by said cam which rotates together with said camshaft, wherein said camshaft is supported in a cam holder fastened to a cylinder head; and a fall-preventive unit for preventing the fall of said rocker arm in an axial direction of said camshaft through the contact with said rocker arm, said fall-preventive unit projecting further in said axial direction toward said rocker arm than a surface of said member which faces said cam wherein said cam holder forms an integral cam holder which integrally includes a plurality of bearing portions provided at intervals in said axial direction of said camshaft, for rotatably supporting said camshaft, and a partitioning portion disposed between adjacent bearing portions;

wherein said fall-preventive unit comprises a plurality of fall-preventive units integrally provided on a respective one of said bearing portions and on said partitioning portion.

6. The internal combustion engine as set forth in claim 5, wherein said fall-preventive unit faces an upper end portion of said rocker arm which faces said cam in a vertical direction.

7. An internal combustion engine with a valve train, comprising:

a rocker arm having a proximal portion which is spherically supported by an oscillating support member and an operating portion abutting with an engine valve;

a camshaft having a cam adapted to be brought into sliding contact with said rocker arm and disposed above said rocker arm, wherein said engine valve is operated to open and close by said rocker arm which is oscillated by said cam which rotates together with said camshaft; and a fall-preventive unit provided on a member which faces said cam and said rocker arm in an axial direction of said camshaft for preventing the fall of said rocker arm in said axial direction through the contact with said rocker arm, said fall-preventive unit projecting further in said axial direction toward said rocker arm than a surface of said member which faces said cam, wherein said fall-preventive unit faces an upper end portion of said rocker arm which faces said cam in a vertical direction, and wherein said member on which said fall-preventive unit is provided is a bearing portion for rotatably supporting said camshaft, and wherein said fall-preventive unit is a projection which is integrally formed on a side of said bearing portion which faces said rocker arm in said axial direction.

8. An internal combustion engine with a valve train, comprising:

a rocker arm having a proximal portion which is spherically supported by an oscillating support member and an operating portion abutting with an engine valve;

a camshaft having a cam adapted to be brought into sliding contact with said rocker arm and disposed above said rocker arm, wherein said engine valve is operated to open and close by said rocker arm which is oscillated by said cam which rotates together with said camshaft; and a fall-preventive unit provided on a member which faces said cam and said rocker arm in an axial direction of said camshaft for preventing the fall of said rocker arm in said axial direction through the contact with said rocker arm, said fall-preventive unit projecting further in said axial direction toward said rocker arm than a surface of said member which faces said cam, wherein said member on which said fall-preventive unit is provided is a bearing portion for rotatably supporting said camshaft, and wherein said fall-preventive unit is a projection which is integrally formed on a side of said bearing portion which faces said rocker arm in said axial direction.

9. An internal combustion engine with a valve train, comprising:

a rocker arm having a proximal portion which is spherically supported by an oscillating support member and an operating portion abutting with an engine valve;

a camshaft having a cam adapted to be brought into sliding contact with said rocker arm and disposed above said rocker arm, wherein said engine valve is operated to open and close by said rocker arm which is oscillated by said cam which rotates together with said camshaft; and a fall-preventive unit provided in such a manner as to face only one side of said rocker arm in an axial direction of said camshaft for preventing the fall of said rocker arm in said axial direction through the contact with said rocker arm, wherein the center of gravity of said rocker arm is situated at a position where a moment is generated that tilts said rocker arm toward said one side.

10. The internal combustion engine as set forth in claim 9, wherein said fall-preventive unit faces an upper end portion of said rocker arm which faces said cam in a vertical direction.

11. The internal combustion engine as set forth in claim 10, wherein said fall-preventive unit is a projection which is integrally formed on a side of a bearing portion for rotatably supporting said camshaft, said side of said bearing facing said rocker arm in said axial direction.

12. The internal combustion engine as set forth in claim 9, wherein said fall-preventive unit is a projection which is integrally formed on a side of a bearing portion for rotatably supporting said camshaft, said side of said bearing facing said rocker arm in said axial direction.

13. An integral cam holder for an internal combustion engine which is fastened to a cylinder head, comprising:

a plurality of bearing portions being provided at intervals in an axial direction of a camshaft of a valve train for operating engine valves to open and close, for rotatably supporting said camshaft;

primary and secondary longitudinal frames situated at end portions of each of said bearing portions and extending in said axial direction while connecting said bearing portions which are adjacent to each other in said axial direction at first connecting portions, said primary and secondary longitudinal frames being integrally formed with each other, wherein a rocker arm of said valve train is disposed in a through space which is formed by being surrounded by said adjacent bearing portions and said primary and secondary longitudinal frames, and a partitioning portion connected to said primary and secondary longitudinal frames at second connecting portions between said adjacent bearing portions in such a manner as to be integrally formed with said primary and secondary longitudinal frames, for partitioning said through space in said axial direction to thereby form small through spaces.

14. The integral cam holder as set forth in claim 13, wherein a plurality of said rocker arms are disposed in said through space at intervals in said axial direction, and wherein said partitioning portion is disposed between said rocker arms which are adjacent to each other in said axial direction in such a manner as to overlap said rocker arms as viewed in said axial direction.

15. The integral cam holder as set forth in claim 13, wherein a fastening portion for fastening said cam holder to said cylinder head is formed at said second connecting portion between said primary longitudinal frame and said partitioning portion.

16. The integral cam holder as set forth in claim 14, wherein a fastening portion for fastening said cam holder to said cylinder head is formed at said second connecting portion between said primary longitudinal frame and said partitioning portion.

17. The integral cam holder as set forth in claim 13, wherein a primary oil passage is formed in said primary longitudinal frame, wherein a fastening portion for fastening said cam holder to said cylinder head is formed at said first connecting portion between said primary longitudinal frame and said bearing portion or said second connecting portion between said primary longitudinal frame and said partitioning portion, wherein said fastening portion forms an oil feed passage adapted to communicate with said primary oil passage and to feed lubricating oil to a hydraulic lash adjuster which is mounted on said cylinder head in such a manner as to come into abutment with said rocker arm, and wherein said oil feed passage connects to a secondary oil passage formed in said cylinder head so as to communicate with said lash adjuster.

18. The integral cam holder as set forth in claim 14, wherein a primary oil passage is formed in said primary longitudinal frame, wherein a fastening portion for fastening said cam holder to said cylinder head is formed at said first connecting portion between said primary longitudinal frame and said bearing portion or said second connecting portion between said primary longitudinal frame and said partitioning portion, wherein said fastening portion forms an oil feed passage adapted to communicate with said primary oil passage and to feed lubricating oil to a hydraulic lash adjuster which is mounted on said cylinder head in such a manner as to come into abutment with said rocker arm, and wherein said oil feed passage connects to a secondary oil passage formed in said cylinder head so as to communicate with said lash adjuster.

* * * * *